US008403374B2

(12) United States Patent
Shimizu et al.

(10) Patent No.: US 8,403,374 B2
(45) Date of Patent: Mar. 26, 2013

(54) LOCK SYSTEM

(75) Inventors: Toshihiro Shimizu, Kanagawa (JP); Toshihiko Okawara, Kanagawa (JP); Tetsu Hirano, Kanagawa (JP)

(73) Assignee: Piolax, Inc., Yokohama-Shi, Kanagawa (JP)

( * ) Notice: Subject to any disclaimer, the term of this patent is extended or adjusted under 35 U.S.C. 154(b) by 347 days.

(21) Appl. No.: 12/448,552

(22) PCT Filed: Nov. 12, 2007

(86) PCT No.: PCT/JP2007/071903

§ 371 (c)(1),
(2), (4) Date: Jun. 25, 2009

(87) PCT Pub. No.: WO2008/087786

PCT Pub. Date: Jul. 24, 2008

(65) Prior Publication Data

US 2010/0013244 A1 Jan. 21, 2010

(30) Foreign Application Priority Data

Jan. 19, 2007 (JP) ..... P2007-010883

(51) Int. Cl.

| | |
|---|---|
| ***E05C 1/00*** | (2006.01) |
| ***E05C 9/16*** | (2006.01) |
| ***E05C 1/06*** | (2006.01) |
| ***E05C 1/02*** | (2006.01) |
| ***E05C 1/08*** | (2006.01) |
| ***B62H 5/04*** | (2006.01) |

(52) U.S. Cl. ..... 292/32; 292/36; 292/141; 292/137; 292/163; 70/208

(58) Field of Classification Search ..... 292/32, 292/36, 141, 137, 157, 163, 164, 169, 170, 292/171, DIG. 38; 70/208

See application file for complete search history.

(56) References Cited

U.S. PATENT DOCUMENTS 3,596,952 A * 8/1971 Hinkle et al. ..... 292/27
4,118,055 A * 10/1978 Bischoff, Jr. ..... 292/165

(Continued)

FOREIGN PATENT DOCUMENTS

CN 1498791 A 5/2004
JP 2001-349116 12/2001

(Continued)

OTHER PUBLICATIONS

Chinese Office Action dated Mar. 2, 2011, with English translation.

*Primary Examiner* — Thomas Beach
*Assistant Examiner* — Nathan Cumar
(74) *Attorney, Agent, or Firm* — McGinn IP Law Group, PLLC

(57) ABSTRACT

A lock system is provided which is made to facilitate connecting work of a slide pin with a cam member and reduce looseness in the connected state.

A post-like portion 32 which projects in an axial direction and double side projecting portions 33, 33 which project from end portion of the post-like portion to both sides are provided at a connecting end portion 3*c* of a slide pin 3into a cam member 4 of the lock system, and provided at a connecting end portion 4*a* of the cam member 4 to the slide pin are an accommodation recess portion 40 made up of an axial recess portion 41 which receives the post-like portion and lateral recess portions 42 which are expanded from an intermediate position along the length of the axial recess portion so as to receive the double side projecting portions, and an elastic engagement piece 44 which is provided in an axial deeper portion in the accommodation recess portion so as to be brought into engagement with an end portion of the slide pin which lies in a direction in which the post-like portion projects while pressing the end portion in the axial direction. In addition, locking stepped portions adapted to be brought into engagement with the double side projecting portions may be provided on inner surfaces of lateral sides of both the lateral recess portions.

20 Claims, 21 Drawing Sheets

U.S. PATENT DOCUMENTS

| | | | | | |
|---|---|---|---|---|---|
| 4,781,407 | A | * | 11/1988 | Rauchhaus | 292/37 |
| 5,149,152 | A | * | 9/1992 | Lanius | 292/37 |
| 5,342,101 | A | * | 8/1994 | Shih | 292/165 |
| 5,516,163 | A | * | 5/1996 | Baker | 292/169 |
| 5,893,300 | A | * | 4/1999 | Liao | 74/594.4 |
| 6,120,069 | A | * | 9/2000 | Taranto | 292/35 |
| 6,152,512 | A | * | 11/2000 | Brown et al. | 296/37.12 |
| 6,350,418 | B1 | * | 2/2002 | Venderpool et al. | 422/297 |
| 6,460,902 | B1 | * | 10/2002 | Kyle | 292/165 |
| 6,622,883 | B1 | * | 9/2003 | Wu et al. | 220/323 |
| 6,669,243 | B2 | * | 12/2003 | Katoh et al. | 292/34 |
| 6,733,049 | B2 | * | 5/2004 | Piorkowski et al. | 292/139 |
| 6,834,895 | B2 | * | 12/2004 | Lin | 292/34 |
| 7,048,311 | B2 | * | 5/2006 | Sawatani et al. | 292/33 |
| 7,182,373 | B2 | * | 2/2007 | Yamada | 292/32 |
| 7,455,333 | B2 | * | 11/2008 | Ookawara | 292/34 |
| 7,695,028 | B2 | | 4/2010 | Katou et al. | |
| 7,832,239 | B2 | * | 11/2010 | Kozuka et al. | 70/162 |
| 2004/0189012 | A1 | * | 9/2004 | Katou et al. | 292/34 |
| 2007/0163310 | A1 | * | 7/2007 | Ookawara et al. | 70/208 |

FOREIGN PATENT DOCUMENTS

| | | | |
|---|---|---|---|
| JP | 2001349116 | A * | 12/2001 |
| JP | 2004-156331 | | 6/2004 |
| JP | 2005-127020 | | 5/2005 |

* cited by examiner

LOCK SYSTEM

TECHNICAL FIELD

The present invention relates to a lock system which is used for, for example, a glove box which is pivotally supported to rotate on an instrument panel of a motor vehicle.

BACKGROUND ART

There is known as a lock system like this a lock system that is described in Patent Document 1 below that was filed by the applicant (i.e. assignee) of the present invention. Namely, Patent Document 1 discloses a lock system having a support structure which includes a storage space, a lid element which is pivotally supported to rotate on the support structure so as to close the storage space, a slide pin which is supported movably on the lid element so as to be engaged with and disengaged from the support structure, a spring member for biasing the slide pin so as to be locked on the support structure, an operation handle which is pivotally supported to swing on the lid element for releasing the lock of the spindle, and a motion transforming mechanism for transforming swing of the operation handle into movement of the slide pin, the lock system having an outer cylindrical member which is linked to either the operation handle or the slide pin, an inner cylindrical member which is linked to the other and is fitted concentrically and movably in the outer cylindrical member, and an O ring which is brought into sliding contact with the outer cylindrical member and the inner cylindrical member at the same time.

In addition, Patent Document 1 discloses an embodiment in which an outer cylindrical member is provided on an operation handle, an inner cylindrical member is made as a cam member, an outer end portion of this cam member is formed into an angular tube-like shape, an elastically deformable inserting portion is provided at a connection side of a slide pin, a projection is provided on this inserting portion for engagement with an engagement hole formed in a side wall of the angular tube-like end portion, and the inserting portion is inserted into the angular tube-like end portion in such a manner that the projection is brought into engagement with the engagement hole so as to prevent the dislocation of the slide pin from the cam member.

Patent Document 1: JP-2005-127020-A

DISCLOSURE OF THE INVENTION

Problem that the Invention is to Solve

In the lock system described in Patent Document 1 above, however, since the construction is adopted in which the inserting portion formed at the connecting end portion of the slide pin is inserted into the angular tube-like end portion of the cam member from the axial direction for connection, there has been a problem that the inserting operation is made difficult and hence, the assembling properties are not good. In addition, there has been a situation where even though the projection of the inserting portion is brought into engagement with the engagement hole in the angular tube-like end portion, looseness is caused due to a gap between the inserting portion and the angular tube-like end portion and a gap between the projection and the engagement hole. Further, the shape of the angular tube-like end portion of the cam member is complex, and this has led to a problem that the construction of a mold becomes complex.

Consequently, an object of the invention is to provide a lock system in which a slide pin is made to be shifted in an axial direction by a cam mechanism which links with an operation handle for unlocking, wherein connection work of the slide pin with the cam member can be facilitated and looseness in the connected state can be reduced.

Means for Solving the Problem

With a view to attaining the object, according to a first invention, there is provided a lock system including: a support structure including a storage space; a lid element pivotally supported to rotate on the support structure so as to close the storage space; a slide pin supported movably on the lid element so as to be engaged with and disengaged from the support structure; a spring member that biases the slide pin so as to be locked on the support structure; an operation handle pivotally supported to swing on the lid element; a tube-like member connected to the operation handle; a cam member of which one end is inserted into the tube-like member and to the other end of which the slide pin is connected; and a cam mechanism provided between the tube-like member and the cam member to transform a swinging motion of the operation handle into an axial movement of the slide pin, characterized in that: a post-like portion projecting in an axial direction and double lateral projecting portions which project to both sides from the post-like portion are provided at a connecting portion of the slide pin to the cam member; and an accommodation recess portion made up of an axial recess portion to receive the post-like portion and lateral recess portions formed by extending a width of the axial recess portion from an intermediate position along a length thereof to receive the double lateral projecting portions and an elastic engagement piece provided at an axially deep portion of the accommodation recess portion and adapted to be brought into engagement with an end portion of the slide pin in a direction in which the post-like portion projects while pressing the end portion in the axial direction are provided at a connecting portion of the cam member to the slide pin.

According to the invention, when the post-like portion and the double lateral projecting portions which are formed at the connecting end portion of the slide pin are inserted into the axial recess portion and the lateral recess portions, respectively, which are formed in the connecting end portion of the cam member, the axial end portion of the slide pin is brought into engagement with the elastic engagement piece, whereby the slide pin is prevented from being dislocated with respect to the direction in which the slide pin is inserted into the accommodation recess portion. In addition, the double lateral projecting portions of the slide pin are brought into engagement with the lateral recess portions of the cam member, whereby the slide pin is prevented from being dislocated with respect to the axial direction. In this way, since the slide pin can be built into the cam member from the direction at right angles to the axial direction for connection therewith, the mounting work of the slide pin on the cam member is facilitated, thereby making it possible to enhance the building properties. Further, since the elastic engagement piece presses against the end portion of the slide pin in the axial direction, the double lateral projecting portions of the slide pin are brought into press contact with inner circumferences of the lateral recess portions of the cam member, thereby making it possible to prevent the occurrence of looseness. In addition, since the connecting end portion of the cam member has the accommodation recess portion which is made to open to the direction which intersects the axial direction at right angles and has a box shape as a whole, an advantage can also be obtained that the construction of a molding die becomes relatively simple.

According to a second invention, there is provided a lock system including: a support structure including a storage space; a lid element pivotally supported to rotate on the support structure so as to close the storage space; a slide pin supported movably on the lid element so as to be engaged with and disengaged from the support structure; a spring member that biases the slide pin so as to be locked on the support structure; an operation handle pivotally supported to swing on the lid element; a tube-like member connected to the operation handle; a cam member of which one end is inserted into the tube-like member and to the other end of which the slide pin is connected; and a cam mechanism provided between the tube-like member and the cam member to transform a swinging motion of the operation handle into an axial movement of the slide pin, characterized in that: a post-like portion projecting in an axial direction and double lateral projecting which project to both sides from the post-like portion are provided at a connecting portion of the slide pin to the cam member; and an accommodation recess portion made up of an axial recess portion to receive the post-like portion and lateral recess portions formed by extending a width of the axial recess portion from an intermediate position along a length thereof to receive the double lateral projecting portions and locking stepped portions formed on both inner sides of the lateral recess portions so as to be brought into engagement with the double lateral projecting portions are provided at a connecting portion of the cam member to the slide pin.

According to the invention, when the post-like portion and the double lateral projecting portions which are formed at the connecting end portion of the slide pin are inserted into the axial recess portion and the lateral recess portions, respectively, which are formed in the connecting end portion of the cam member, the double lateral projecting portions of the slide pin are brought into engagement with the locking stepped portions which are formed inwards of the lateral recess portions of the cam member, whereby the slide pin is prevented from being dislocated with respect to the direction in which the slide pin is inserted into the accommodation recess portion. In addition, the double lateral projecting portions of the slide pin are brought into engagement with the lateral recess portions of the cam member, whereby the slide pin is prevented from being dislocated with respect to the axial direction thereof. In this way, the slide pin can be built into the cam member from the direction at right angles to the axial direction for connection therewith. Then, since the double side projecting portions of the slide pin are brought into engagement with the locking stepped portions of the cam member so that the end portion of the slide pin are fastened on both left and right sides thereof, the slide pin can be held without any looseness.

According to a third invention, there is provided a lock system including: a support structure including a storage space; a lid element pivotally supported to rotate on the support structure so as to close the storage space; a slide pin supported movably on the lid element so as to be engaged with and disengaged from the support structure; a spring member that biases the slide pin so as to be locked on the support structure; an operation handle pivotally supported to swing on the lid element; a tube-like member connected to the operation handle; a cam member of which one end is inserted into the tube-like member and to the other end of which the slide pin is connected; and a cam mechanism provided between the tube-like member and the cam member to transform a swinging motion of the operation handle into an axial movement of the slide pin, characterized in that: a post-like portion projecting in an axial direction and double lateral projecting which project to both sides from the post-like portion are provided at a connecting portion of the slide pin to the cam member; an accommodation recess portion made up of an axial recess portion to receive the post-like portion and lateral recess portions formed by extending a width of the axial recess portion from an intermediate position along a length thereof to receive the double lateral projecting portions is provided at a connecting portion of the cam member to the slide pin; and abutment surfaces with an end face of the slide pin which is situated around a proximal portion of the post-like portion and an end face of the connecting end portion of the cam member are made to approach and confront each other in a position lying further rearwards than the double side projecting portions with respect to an inserting direction of the slide pin into the accommodation recess portion.

According to the invention, by inserting the post-like portion and the double side projecting portions which are formed at the connecting end portion of the slide pin into the axial recess portion and the lateral recess portions, respectively, which are formed in the connecting end portion of the cam member, the double side projecting portions of the slide pin are brought into engagement with the lateral recess portions, whereby the slide pin is prevented from being dislocated with respect to the axial direction thereof. In this state, even in the event that the slide pin is bent about the double lateral projecting portions or attempts to swing, since the abutment surfaces with the end face of the slide pin which is situated on the periphery of the proximal portion of the post-like portion and the connecting end portion of the cam member approach and confront each other in the position lying rearwards in the direction in which the slide pin is inserted into the accommodation recess portion, the slide pin is brought into abutment with the portions which approach and confront each other, whereby the bending or oscillation of the slide pin can be prevented, thereby making it possible to hold the slide pin without any looseness.

According to a fourth invention, there is provided the lock system according to any one of the first to third inventions, characterized in that: a pair of projecting portions adapted to be brought into abutment with both lateral sides of the connecting end portion of the cam member are provided on the end face of the slide pin which is situated around the periphery of the proximal portion of the post-like portion.

According to the invention, since the pair of projecting portions provided on the end face of the connecting end portion of the slide pin are brought into abutment with both the lateral sides of the connecting end portion of the cam member, the opening of both lateral side walls of the connecting end portion of the cam member in a width direction is suppressed, and when the double side projecting portions of the slide pin are inserted in the lateral recess portions of the cam member, the double side projecting portions can be held firmly. In addition, in the case of locking stepped portions being formed in the lateral recess portions of the cam member, the double side projecting portions can be brought into strong and rigid engagement with the locking stepped portions.

According to a fifth invention, there is provided the lock system according to the fourth invention, characterized in that: the pair of projecting portions provided on the end face of the slide pin which are situated around the proximal portion of the post-like portion are provided in a position which is offset rearwards with respect to the inserting direction of the slide pin into the accommodation recess portion; guide recess portions are formed on the connecting end portion of the cam member from both lateral side corner portions to an intermediate portion along the length thereof; and the projecting portions are made to be inserted into the guide recess portions.

According to the invention, when the slide pin is attempted to be inserted into the accommodation recess portion in the cam member from an opposite surface side due to misunderstanding of the build-in direction of the slide pin, the pair of projecting portions are first inserted into the guide recess portions and cannot be inserted completely due to the guide portions being formed only to the intermediate position in the inserting direction. This can prevent the slide pin from being erroneously built in.

According to a sixth invention, there is provided the lock system according to any one of the first to fifth inventions, characterized in that: engagement projections situated at a side of an inserting direction of the slide pin into the accommodation recess portion are formed on respective end faces of the double side projecting portions of the slide pin; and locking stepped portions with which the engagement projections are to be brought into engagement are provided on inner surfaces of the lateral recess portions of the cam member.

According to the invention, since the engagement projections provided on the respective end faces of the double side projecting portions of the slide pin are brought into engagement with the locking stepped portions of the lateral recess portions of the cam member, the dislocation preventive holding force can be enhanced.

According to a seventh invention, there is provided the lock system according to the sixth invention, characterized in that: a pair of projecting portions adapted to be brought into abutment with both sides of the connecting end portion of the cam member are provided on the end face of the slide pin which is situated around the proximal portion of the post-like portion in a position which is offset rearwards with respect to the inserting direction of the slide pin into the accommodation recess portion; and the projecting portions are disposed further rearwards in the inserting direction than the engagement projections formed on the double side projecting portions.

According to the invention, since the pair of projecting portions are disposed further rearwards in the slide pin inserting direction (in other words, closer to an opening in the accommodation recess portion) than the engagement projections formed on the double side projecting portions to fasten both the side walls of the cam member so as not to open, the dislocation preventive force when the engagement projections on the double side projecting portions are brought into engagement with the engaging stepped portion on the lateral recess portions can be enhanced.

According to an eighth invention, there is provided the lock system according to any one of the first to seventh inventions, characterized in that: a distal end projection is formed on an axial end face of the post-like portion of the slide pin so as to be offset in inserting direction of the slide pin into the accommodation recess portion; and an elastic engagement piece having a locking claw portion with which the distal end projection is to be brought into engagement is provided in an axially deep portion of the accommodation recess portion of the cam member.

According to the invention, since the distal end projection is inserted while deflecting the locking claw portion of the elastic engagement piece provided in the axial deep portion of the accommodation recess portion, the insertion of the connecting end portion of the slide pin into the accommodation recess portion of the cam member can be facilitated, thereby making it possible to impart a strong dislocation preventive force when in engagement.

According to a ninth invention, there is provided the lock system according to the eighth invention, characterized in that: the elastic engagement piece bends to extend from an opening side towards a bottom portion side of the accommodation recess portion in the deep portion thereof; and the locking claw portion is formed at a lower end portion thereof.

According to the invention, since the elastic engagement piece can be elongated, when the connecting end portion of the slide pin is inserted, the elastic engagement piece can be deflected so as to facilitate the insertion of the slide pin.

According to a tenth invention, there is provided the lock system according to the eighth or ninth invention, characterized in that: the distal end projection is disposed so as to be offset closer to a side of the inserting direction of the slide pin into the accommodation recess portion than a center of the axial end face of the post-like portion of the slide pin.

According to the invention, since the distal end projection on the axial end face of the post-like portion of the slide pin is disposed so as to be offset to the side of the slide pin inserting direction from which the slide pin is inserted and is brought into engagement with the elastic engagement piece at the bottom portion side of the accommodation recess portion, the slide pin is made more difficult to be dislocated.

According to an eleventh invention, there is provided the lock system according to any one of the first to tenth inventions, characterized in that: the double side projecting portions of the slide pin each have an angular cross section; and the lateral recess portions of the cam member has an inner circumferential surface to which at least one side of each of the double side projecting portions of the slide pin is fitted.

According to the invention, since at least one side of each of the double side projecting portions each having the angular cross section is made to be fitted to the inner surfaces of the lateral recess portions for abutment therewith, the looseness of the slide pin is suppressed, so that the slide pin can be held with high rigidity relative to the cam member, thereby making it possible to ensure the prevention of dislocation of the slide pin from the accommodation recess portion. In addition, not only can chattering vibrations attributed to looseness be prevented so as to suppress the generation of abnormal noise, but also the integrity between the slide pin and the cam member can be enhanced, whereby engaging and disengaging motions of the slide pin with and from the support structure when the operation handle is operated are made smooth.

Further, since the double side projecting portions of the slide pin each have the angular cross section, an abutment area between the inner surface of the accommodation recess and the double side projecting portions of the slide pin is increased, and as a result, the contact surface pressure of the double side projecting portions against the accommodation recess portion can be reduced. Because of this, even though sliding operations are performed repeatedly between the double side projecting portions of the slide pin and the accommodation recess portion of the cam member as a result of repetition of opening and closing operations of the lid element, wear of the double side projecting portions of the slide pin and the accommodation recess portion of the cam member can be reduced. By this, the aforesaid advantages can be exhibited for a long period of time which include the prevention of dislocation of the slide pin from the accommodation recess portion, prevention of chattering vibration, suppression of abnormal noise and enhancement of the integrity between the slide pin and the cam member.

According to a twelfth invention, there is provided the lock system according to the sixth invention, characterized in that: the engagement projections of the slide pin are formed on the respective end faces of the double side projecting portions rearwards in the inserting direction of the slide pin into the accommodation recess portion.

According to the invention, since the engagement projections of the slide pin are formed on the respective end faces of the double side projecting portions in the positions lying closer to the rear in the slide pin inserting direction, the locking stepped portions which are brought into engagement with the engagement projections of the slide pin can be provided closer to the rear in the slide pin inserting direction. As a result, the locking stepped portions provided on the inner surfaces of the lateral recess portions of the accommodation recess portion are made easy to be deflected, whereby a pushing force required when inserting the connecting end portion of the slide pin into the accommodation recess portion can be reduced, thereby making it possible to increase the building properties of the slide pin into the cam member.

According to a thirteenth invention, there is provided the lock system according to any one of the first to twelfth inventions, characterized in that: the post-like portion of the slide pin has an angular cross section, and in that the axial recess portion of the cam member has an inner circumferential surface to which at least one side of the post-like portion of the slide pin is fitted.

According to the invention, when a force is applied in a direction in which the slide pin rotates relative to the cam member, since at least one side of the post-like portion of the slide pin which has the angular cross section is brought into abutment with the inner circumferential surface of the axial recess portion of the cam member, the rotation of the slide pin is prevented. By this, the looseness of the slide pin in its rotating direction can be suppressed so as to be held by the cam member with high rigidity, thereby making it possible to enhance the integrity between the slide pin and the cam member.

ADVANTAGE OF THE INVENTION

According to the lock system of the invention in which the slide pin is caused to shift in the axial direction by the cam mechanism which is linked with the operation handle for unlocking, since the slide pin can be built into the cam member for connection therewith from the direction at right angles to the axial direction, the mounting work of the slide pin on to the cam member is facilitated, thereby making it possible to enhance the building properties. In addition, the looseness in the state where the slide pin and the cam member are connected together can be reduced.

BRIEF DESCRIPTION OF THE DRAWINGS

FIGS. 3A to 3D are diagrams depicting a cam member of the lock system, of which FIG. 3A is a front view, FIG. 3B is a bottom view, FIG. 3C is a rear view, and FIG. 3D is a sectional view taken along the line B-B in FIG. 3A.

FIGS. 6A and 6B are diagrams depicting a connecting construction between the cam member and a slide pin of the same lock system, of which FIG. 6A is a perspective view of a connecting end portion of the slide pin, and FIG. 6B is a perspective view of a connecting end portion of the cam member.

FIGS. 7A and 7B are diagrams depicting the slide pin, of which FIG. 7A is a front view depicting the slide pin with an intermediate portion thereof omitted, and FIG. 7B is a plan view depicting the slide pin with the intermediate portion thereof omitted.

FIGS. 9A and 9B are diagrams depicting the connecting construction between the slide pin and the cam member, of which FIG. 9A is a plan view, and FIG. 9B is a front view.

FIGS. 13A and 13B are diagrams depicting a second embodiment of a lock system according to the invention, of which FIG. 13A is a perspective view of a connecting end portion of a slide pin, and FIG. 13B is a perspective view of a connecting end portion of a cam member.

FIGS. 14A and 14B are diagrams depicting the slide pin of the lock system, of which FIG. 14A is a front view of the slide pin with an intermediate portion thereof omitted, and FIG. 14B is a plan view of the slide pin with the intermediate portion thereof omitted.

FIGS. 15A to 15D are diagrams depicting the cam member of the lock system, of which FIG. 15A is a front view, FIG. 15B is a bottom view, FIG. 15C is a rear view, and FIG. 15D is a sectional view taken along the line C-C in FIG. 15A.

FIGS. 16A and 16B are diagrams depicting a connecting construction between the slide pin and the cam member of the lock system, of which FIG. 16A is a partially cutaway perspective view, and FIG. 16B is a perspective view cut away from a different direction.

FIGS. 19A to 19D are diagrams depicting a slide pin of the lock system, of which FIG. 19A is a front view of the slide pin with an intermediate portion thereof omitted, FIG. 19B is a plan view of the slide pin with the intermediate portion thereof omitted, FIG. 19C is a sectional view taken along the line E-E in FIG. 19A, and FIG. 19D is a sectional view taken along the line F-F in FIG. 19A.

FIGS. 20A to 20D are diagrams depicting a cam member of the lock system, of which FIG. 20A is a front view, FIG. 20B is a bottom view, FIG. 20C is a rear view, and FIG. 20D is a sectional view taken along the line C-C in FIG. 20A.

FIGS. 21A and 21B are diagrams depicting a connecting construction between the slide pin and the cam member of the lock system, of which FIG. 21A is a partially cutaway perspective view, and FIG. 21B is a perspective view which is cut away from a different direction.

DESCRIPTION OF REFERENCE NUMERALS AND CHARACTERS

1 operation handle; 2 support frame; 3 slide pin; 3*c* connecting end portion; 4 cam member; 4*a* connecting end portion;

4*b* cam side end portion; 5 compression coil spring (spring member); cylindrical portion; 7 first raised portion; 8 second raised portion; 9 slit; 10 threaded hole; 11 bending wall; 12 opening; 16 flange portion; 20 cam groove; 21 lock groove; 21*a* fillet portion; 22 stepped portion; 23 recessed groove; 24 O ring; 25 accommodation groove; 28 striker; 31 lock hole; 32 post-like portion; 33 double side projecting portions; 34 angular corner portion; 35 projecting portion; 36 distal end projection; 37, 37*a* engagement projection; 38 rib; 40 accommodation recess portion; 41 axial recess portion; 42 lateral recess portion; 43, 43*a* locking claw portion; 44, 44*a* elastic engagement piece; 45 guide recess portion; 46 locking stepped portion; B glove box (lid element); P instrument panel (support structure)

BEST MODE FOR CARRYING OUT THE INVENTION

Hereinafter, referring to FIGS. 1 to 12, a first embodiment of a lock system according to the invention will be described. This lock system is such as to be applied to a side lock system of a glove box B which is mounted in an instrument panel P of a motor vehicle shown in FIG. 12 so as to be opened and closed. Note that when used in the following description, words denoting vertical positions and movements such as "lower/downwards/below" and "upper/upwards/above" mean such positions and movements as viewed on the drawings and do not mean such positions and movements resulting when the lock system is actually mounted on the glove box.

Namely, an accommodation space S for accommodating the glove box B is provided in the instrument panel P, and the glove box B is supported rotatably via a pivot provided in an interior of the accommodation space S. Lock holes 31, 31 are provided in both inner side walls of the accommodation space S. In addition, a striker 28 is installed on an upper side of an opening of the accommodation space S. The glove box B has a vessel-like shape of which an upper portion is opened, and an operation handle 1 is provided at an upper portion on a front surface thereof, a pair of slide pins 3, 3 extending from the operation handle to both sides. The slide pins 3, 3 project from both side walls of the glove box B and are inserted into the lock holes 31, 31, respectively, when the glove box B is closed, whereby the glove box B is locked in a closed state. Then, when the operation handle 1 is pulled towards a near side in that state, the slide pins 3, 3 are made to be retracted into the glove box B to thereby be pulled out of the lock holes 31, 31, whereby the glove box B is unlocked.

Figure 1:
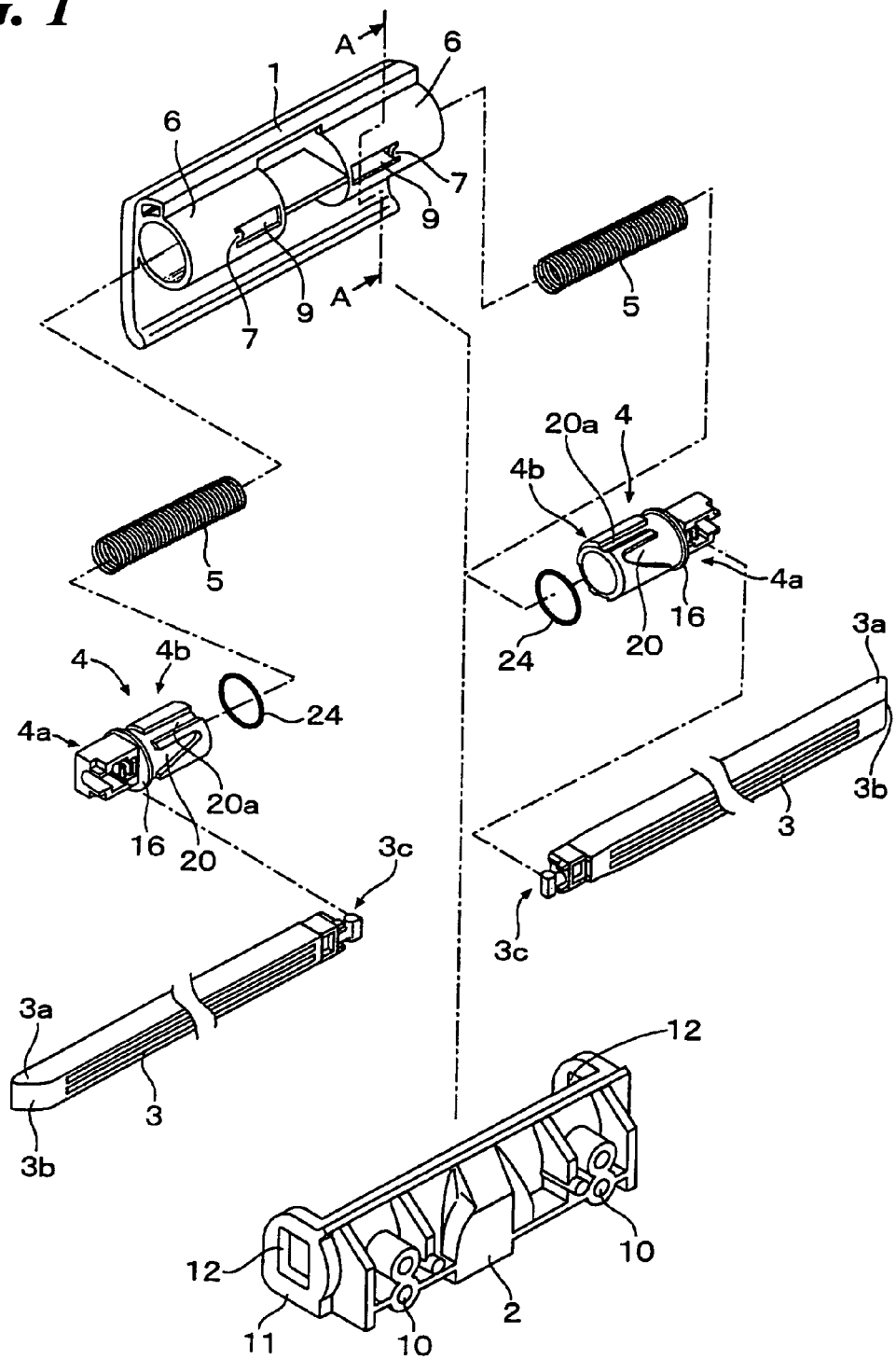
FIG. 1 is an exploded perspective view depicting a first embodiment of a lock system according to the invention.
Figure 2:
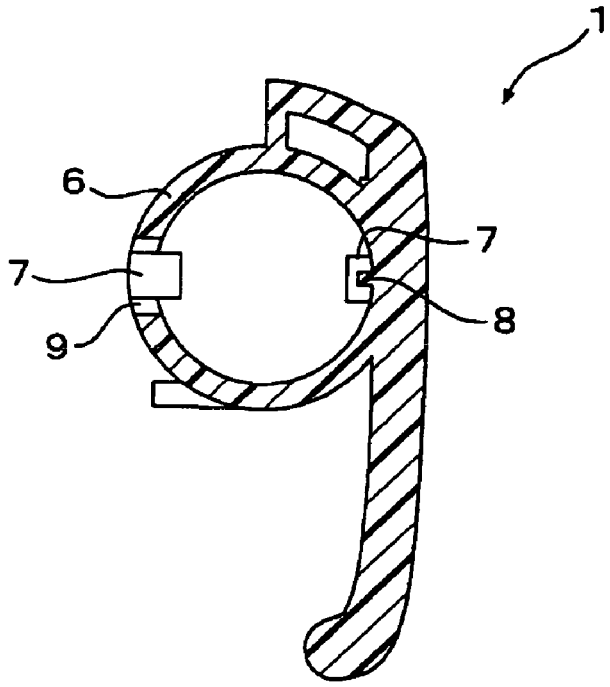
FIG. 2 is a sectional view taken along the line A-A and viewed in a direction indicated by arrows attached thereto in FIG. 1.
Figure 3A:
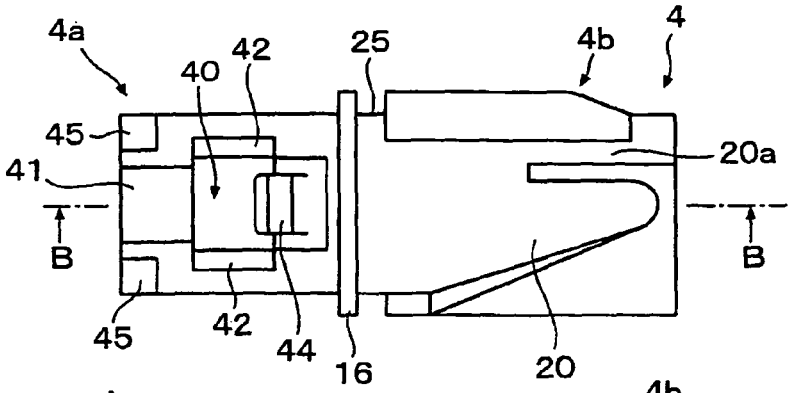
Figure 3B:
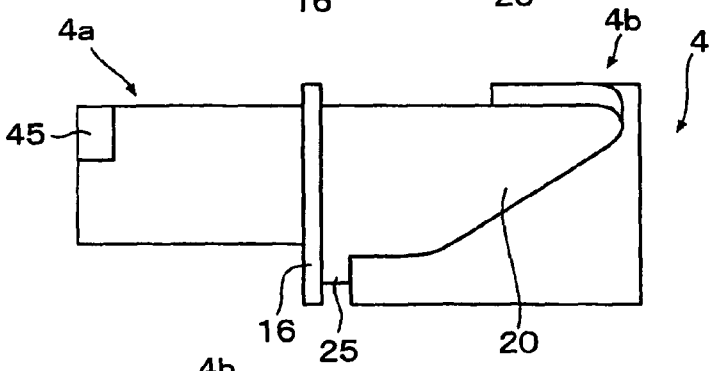
Figure 3C:
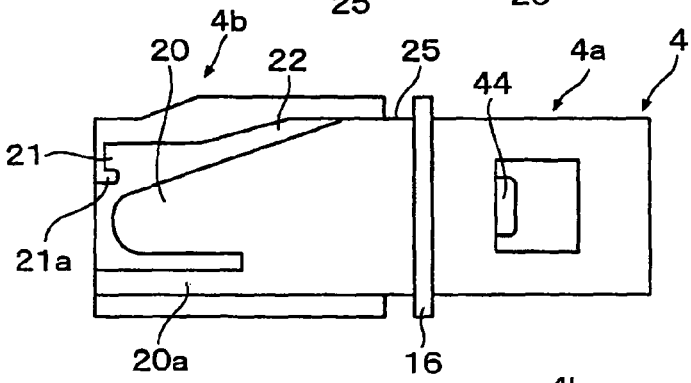
Figure 3D:
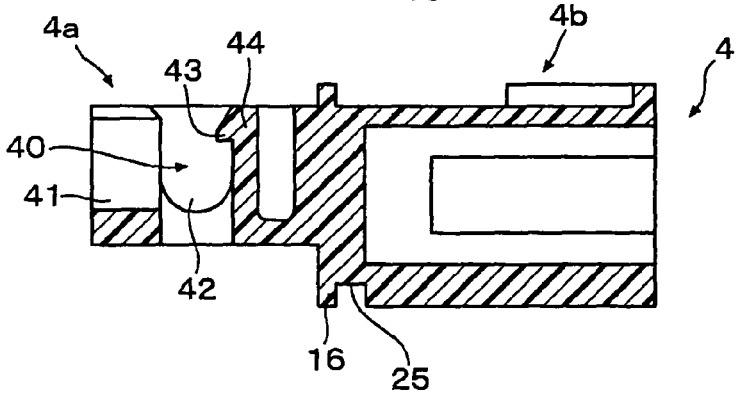

In addition, as is shown in FIG. 1, this lock system is configured to include the operation handle 1 which resides in a recess portion defined in the front surface of the glove box B for controlling the opening and closing of the glove box B, a support frame 2 which supports the operation handle 1 so as to swing and which is screwed to a mounting wall which extends within the recess portion, the pair of left and right slide pins 3, 3, a pair of left and right cam members 4 which activate the left and right slide pins 3, respectively, to advance or retreat, two compression coil springs 5 which are spring members for biasing the left and right slide pins 3 towards the lock holes formed on the instrument panel side, O rings 24 which are mounted on the cam members 4 so as to exhibit a braking force, which will be described later.

As is also shown in FIGS. 3A to 3D, the operation handle 1 is configured to include a pair of cylindrical portions 6 which are formed integrally on a back surface side thereof and which configure left and right bottomed outer cylindrical members which each accommodate the cam member 4 and the compression coil spring 5, pairs of first raised portions 7 which are formed on inner surfaces of the respective cylindrical portions 6 so as to move within cam grooves 20 of the cam members 4, which will be described later, and second raised portions 8 which are formed one on each cylindrical portion 6 in a position lying deeper than the first raised portion 7 so as to be received in a lock groove 21 of the cam member 4. In forming these cylindrical raised portions 7, 8, a slit 9 is provided in the cylindrical portion 6 in a longitudinal direction thereof, the second raised portion 8, which is shorter and thinner than the first raised portion 7, is formed on the inner surface of the cylindrical portion 6 in a position which confronts the slit 9, and one of the first raised portions 7 is formed on an inner circumferential opening edge side of the slit 9, while the other first raised portion 7 is formed on the inner surface of the cylindrical portion 6 in a position which confronts the one of the first raised portions 7. When compared with the second raised portion 8, a longer and thicker shape is given to the pair of first raised portions 7, and as will be described later, the first raised portions 7 and the cam groove 20 cooperate with each other so as to configure a motion transforming mechanism which transforms swinging motion of the operation handle 1 into straight-line motion of the slide pin 3.

The support frame 2 is configured to have a plurality of screw insertion holes 10 which are formed on a back surface side thereof and bent walls 11 which are provided at both ends thereof so as to be bent to extend towards the cylindrical portions 6, with a rectangular opening 12 formed in a central portion of each bent wall 11 so as to permit the appearance and disappearance of an end portion 4*a* of each cam member 4 which configures a connecting end to the slide pin 3 (hereinafter, referred to as a "connecting end portion").

The pair of left and right slide pins 3 each have a distal end portion 3*a* which is formed so as to gradually reduce its thickness towards a front surface side of the glove box B, whereby a tapered surface 3*b* is formed on a side of the slide pin 3 which confronts the back surface side of the glove box B (in a direction in which the slide pin 3 is pushed in when the glove box B is closed). Because of this, when the glove box B is closed, the tapered surfaces 3*b* strike both side edges of the accommodation space S, whereby the slide pins 3 are withdrawn into the glove box B, making it possible for the glove box B to be accommodated within the accommodation space S. As will be described later, a connecting construction which is to be brought into engagement with the connecting end portion 4*a* of the cam member 4 is provided at an end portion 3*c* of the slide pin 3 which configures a connecting end to the cam member 4 (hereinafter, referred to as a "connecting end portion"). This connecting construction configures a characteristic part of the invention, and the connecting construction will be described later.

The pair of cam members 4 are formed transversely symmetrically, and basically, as is shown in FIGS. 3A to 3D, with a flange portion 16 acting as a boundary, one end is made into the connecting end portion 4*a* which is formed into a box shape, and the other end is made into a cam side end portion 4*b* which is formed into a cylindrical shape.

On the cam side end portion 4*b*, the cam groove 20 which exhibits a substantially right-angled triangle shape and a guide groove 20*a* which is parallel to an axis of the cam member 4 are formed on an outer circumference thereof. The cam groove 20 and the guide groove 20*a* are formed to the same depth with a wall interposed therebetween, and a passage which connects the cam groove 20 with the guide groove 20*a* is defined in the vicinity of the flange portion 16. The guide groove 20*a* reaches an end face of the cam side end portion 4*b*, and when the cam member 4 is moved in an axial direction, the first raised portion 7 enters the guide groove 20*a* from the end face side, passes through the passage and is then introduced into the cam groove 20 having the substantially right-angled triangle shape. Then, after the lock system has been built up, when the operation handle 1 is gripped to be pulled upwards, the first raised portion 7 is made to move along an oblique side groove edge of the substantially right-angled triangular groove that forms the cam groove 20 while kept in sliding contact with the oblique groove edge. Note that since a similar cam groove 20 and guide groove 20*a* are formed on the cam side end portion 4*b* in a position which is 180° apart from the position where the cam groove 20 and the guide groove 20*a* are formed, the pair of first raised portions 7 are allowed to be introduced into the corresponding cam grooves 20.

In addition to this, a stepped portion 22 is formed in the vicinity of the oblique side of one of the cam grooves 20 so as to be lower than the outer circumferential surface and higher than a bottom surface of the cam groove 20, and the lock groove 21 which receives the second raised portion 8 is formed on this stepped portion 22. The lock groove 21 is formed as a recess portion inside a wall which is formed outside the substantially right-angled triangular cam groove 20 by causing a wall which is as high as the outer circumferential surface to extend along an outer circumference of the end face of the cam side end portion 4*b* into an L-shape and causing a distal end 21*a* of the wall so formed to project in an axial direction. In addition, since the length of the first raised portion 7 is relatively long, when the first raised portion 7 is inserted into the cam groove 20 to slide therealong, the first raised portion 7 cannot ride on to the stepped portion 22 and is hence made not to enter the lock groove 21. On the other hand, the length of the second raised portion 8 is relatively short, and the second raised portion 8 can slide on the stepped portion 22 so as to be brought into engagement with the lock groove 21. However, even in the event that the second raised portion 8 enters the cam groove 20, the second raised portion 8 is made not to be brought into engagement with a stepped portion between a bottom portion of the cam groove 20 and the stepped portion 22. Consequently, after the second raised portion is removed from the lock groove 21 to complete the assemblage by an assembling method which will be described later, when the first raised portions 7 slide along the cam grooves 20, there is no situation where the sliding of the first raised portions 7 is interrupted by the second raised portion 8, there being no case where the operator is forced to feel an uncomfortable sensation of physical disorder.

In addition, an accommodation groove 25 in which the O ring 24 is mounted is formed at a root side of the flange portion 16 by partially cutting out a wall portion which defines the oblique side groove edge of each cam groove 20, and the O ring 24 is mounted in this accommodation groove 25.

Figure 4:
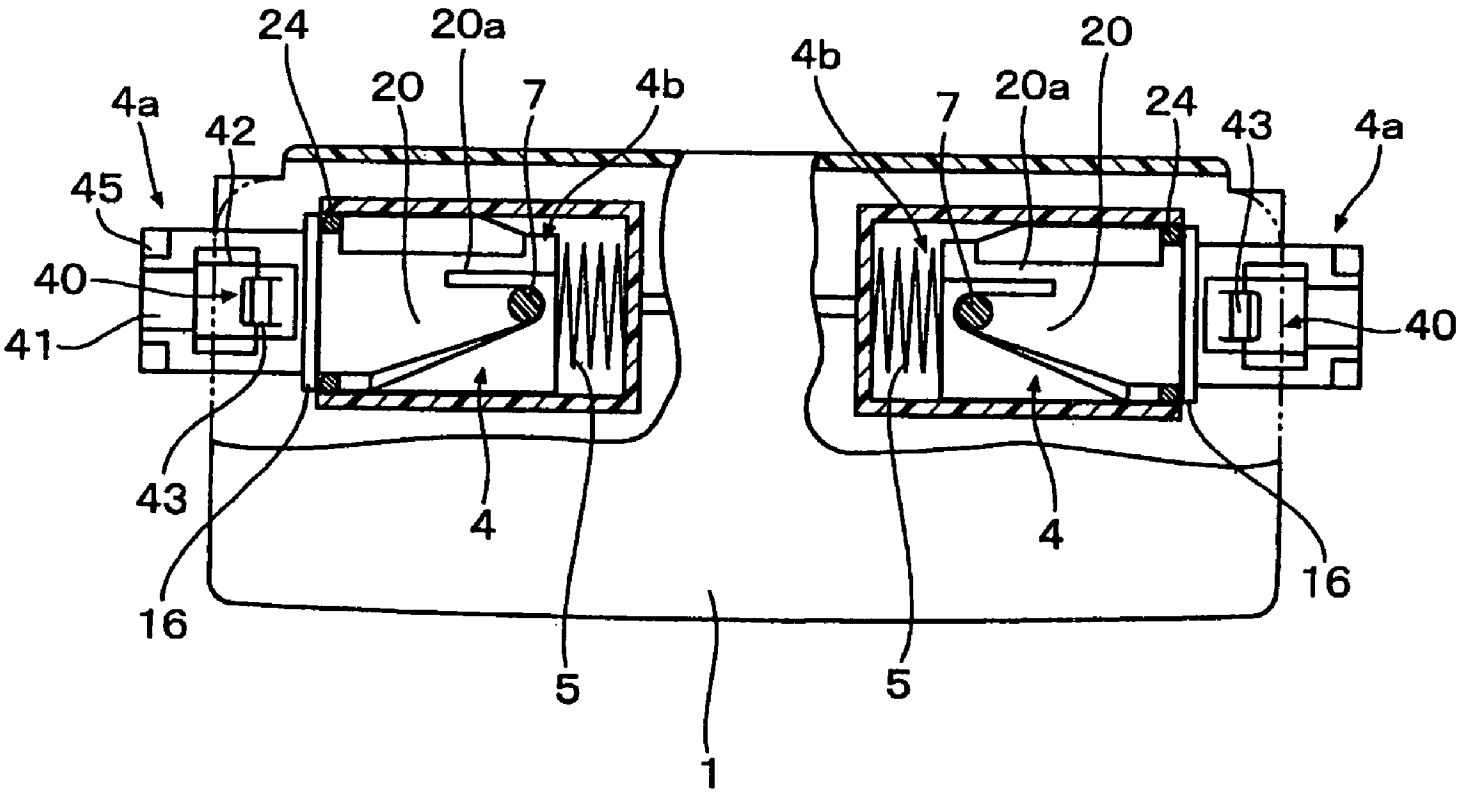
FIG. 4 is a partially sectional rear view depicting a state in which cam members are accommodated in a cylindrical portion of an operation handle of the same lock system and connecting end portions thereof are made to project outwards by compression springs.

Consequently, when the component parts are assembled into the lock system, firstly, the O rings 24 are mounted in the respective accommodation grooves 25 of the cam members 4, and then, the left and right compression coil springs 5 and cam members 4 are individually inserted into the respective cylindrical portions 6 of the operation handle 1. As this occurs, with the first raised portions 7 made to face the interiors of the corresponding guide grooves 20*a* of the pair of cam grooves 20 which are formed on the outer circumference of the cam side end portion 4*b* of the cam member 4, the cam side end portion 4*b* of the cam member 4 is pushed into the interior of the cylindrical portion 6 and is then rotated in a predetermined direction, so that the first raised portions 7 are made to enter the interiors of the cam grooves 20 for engagement therewith. Thus, the left and right cam members are biased by virtue of spring pressures of the respective compression coil springs 5 to be put in a state, as is shown in FIG. 4, where their connecting end portions 4*a* are caused to project outwards.

Figure 5:
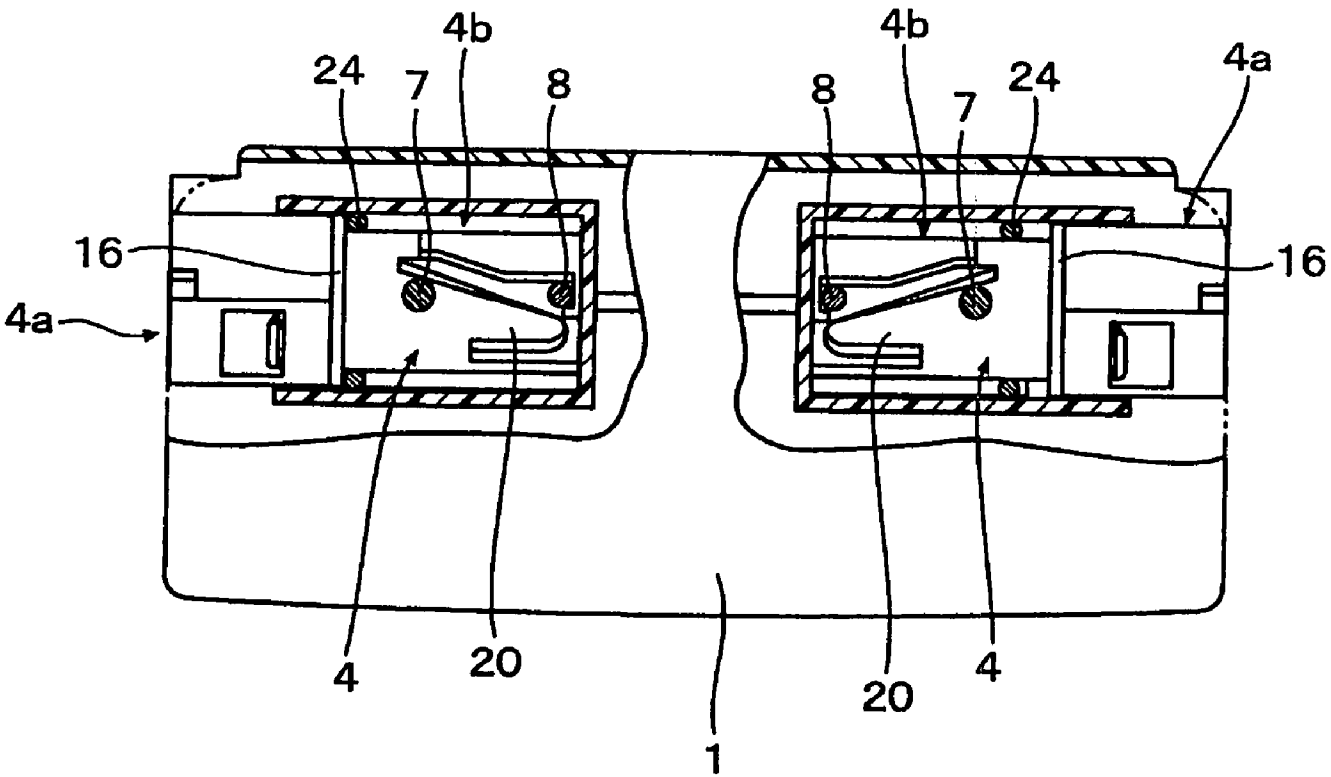
FIG. 5 is a partially sectional rear view depicting a state in which the cam members are retracted against the compression springs in the same operation handle.

Following this, the support frame 2 is assembled to the operation handle 1 which is in the state described above in the next step. As this occurs, the respective cam members 4 are pushed linearly into the corresponding cylindrical portions 6, and then, the operation handle 1 is caused to swing in the operating direction so as to cause the first raised portions 7 to shift outwards within the cam grooves 20, whereby, as is shown in FIG. 5, the second raised portions 8 are introduced into the lock grooves 21, the cam members 4 being thereby pulled into the interiors of the cylindrical portions 6 entirely. Consequently, in the event that the support frame 2 is fitted on the back surface side of the operation handle 1 in the state described above, the support frame can easily be assembled to the operation handle 1 side. In addition, as this occurs, since the first raised portions 7 reside in deep bottoms of the cam grooves 20 and the second raised portions 8 reside in shallow bottoms of the lock grooves 21, there is no such situation that the raised portions 7, 8 interfere with each other.

Consequently, in the event that the support frame 2 is screwed to the mounting wall which extends within the recess portion of the glove box B, the operation handle 1 is supported on the recess portion side so as to swing. As this occurs, since the connecting end portions 4*a* of the left and right cam members 4 are not projecting outwards, the assembling work is facilitated remarkably, and when delivered, since the operation handle 1 can be delivered in such a state that the cam members 4 are pulled thereinto, the delivery form can be made as small as possible.

Next, a connecting construction between the connecting end portion 3*c* of the slide pin 3 and the connecting end portion 4*a* of the cam member 4 will be described.

As is shown in FIGS. 6A to 7B, there are formed at the connecting end portion 3*c* of the slide pin 3 are a post-like portion 32 which projects from a central portion thereof in the axial direction and double side projecting portions 33, 33 which project from an end portion of the post-like portion 32 to both sides. In the case of this embodiment, the double side projecting portions 33, 33 are made up of a shaft portion which intersects the post-like portion 32 almost in a T-shape. When viewing the double lateral projecting portions 33, 33 from end faces thereof, a lower portion is formed into an arc shape, and an upper end portion is made into an angular corner portion 34. In addition, a pair of projecting portions 35, 35 are formed in corner portions at both ends of an upper side of an end face 39 which lies around the periphery of a proximal portion of the post-like portion 32. Further, ribs 38, 38 are formed so as to extend downwards from the projecting portions 35, respectively.

Figure 6A:
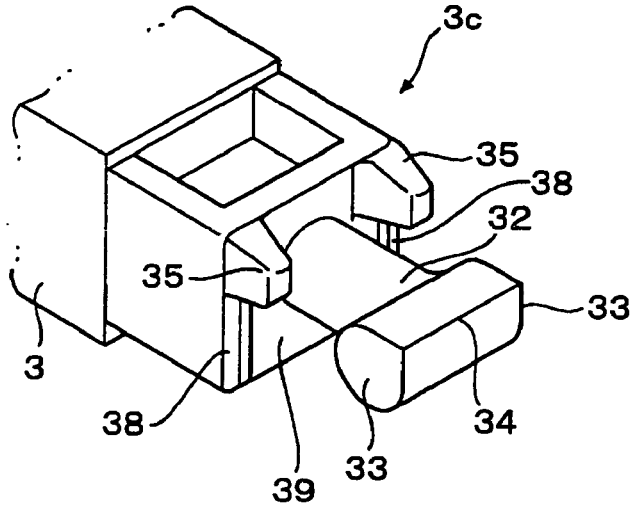
Figure 6B:
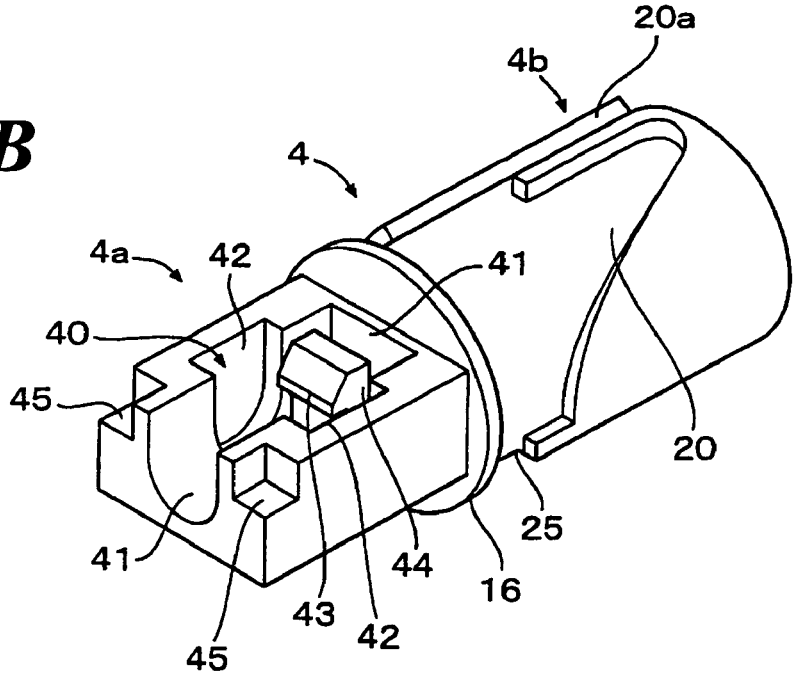

On the other hand, as is shown in FIG. 6B, the connecting end portion 4*a* of the cam member 4 is, as a whole, formed into a box shape which is opened at a front side thereof and has an accommodation recess portion 40 made up of an axial recess portion 41 in which the post-like portion 32 fits and lateral recess portions 42 in which the double side projecting portions 33, 33 fit. In addition, in the case of this embodiment, the axial recess portion 41 is provided so as to extend as far as the vicinity of the flange portion 16 after passing through the lateral recess portions 42.

In addition, an elastic engagement piece 44 is disposed at a deeper end portion of the accommodation recess portion 40 which reaches the vicinity of the flange portion 16, and the elastic engagement piece 44 rises from a bottom wall of the accommodation recess portion 40 and has a locking claw portion 43 at a distal end portion thereof. The locking claw portion 43 is disposed so as to face a side opposite to the flange portion 16.

In addition, guide recess portions 45, 45, which are each formed into a cutout-like shape, are formed in corner portions at both ends of an upper side of the connecting end portion 4*a* of the cam member 4 so as to extend a length to an intermediate position in a direction in which the slide pin 3 is inserted (an intermediate position in a height direction). The projecting portions 35, 35 on the slide pin 3 are made to be inserted into these guide recess portions 45, 45.

Consequently, in this embodiment, connecting work of connecting the slide pin 3 to the cam member 4 will be performed as follows. Firstly, as has been described before, the operation handle 1 and the support frame 2 which have been assembled to each other are mounted within the recess portion on the front side of the glove box B, and the connecting end portions 4*a* of the cam members 4 are caused to project into a state shown in FIG. 4 by moving the operation handle 1.

Figure 8:
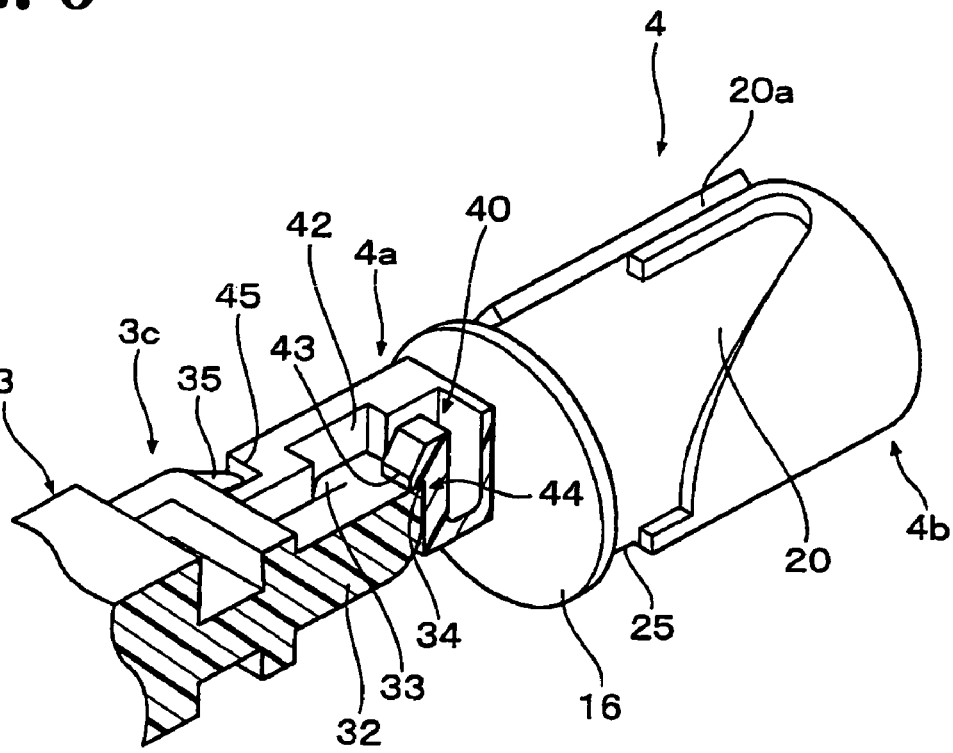
FIG. 8 is a partially cutaway perspective view depicting the connecting construction between the slide pin and the cam member.
Figure 9A:
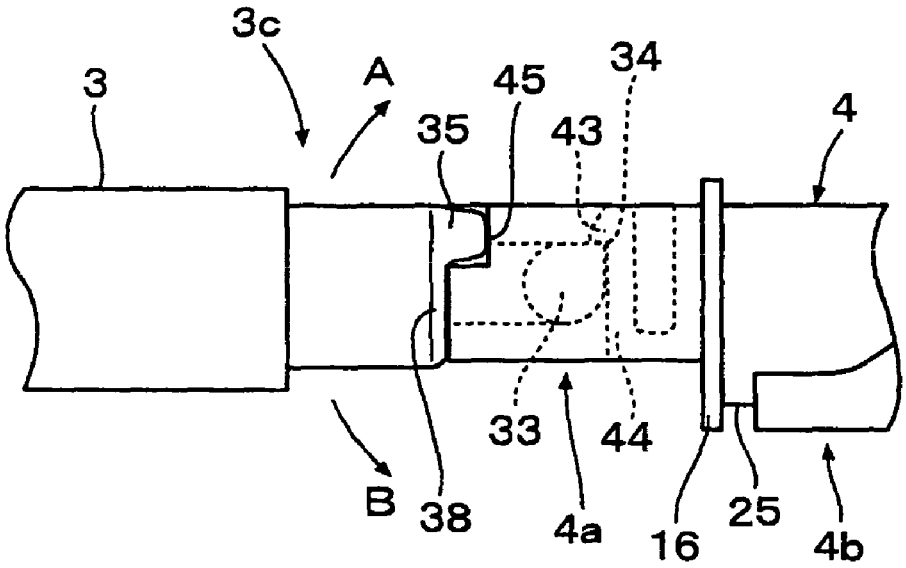
Figure 9B:
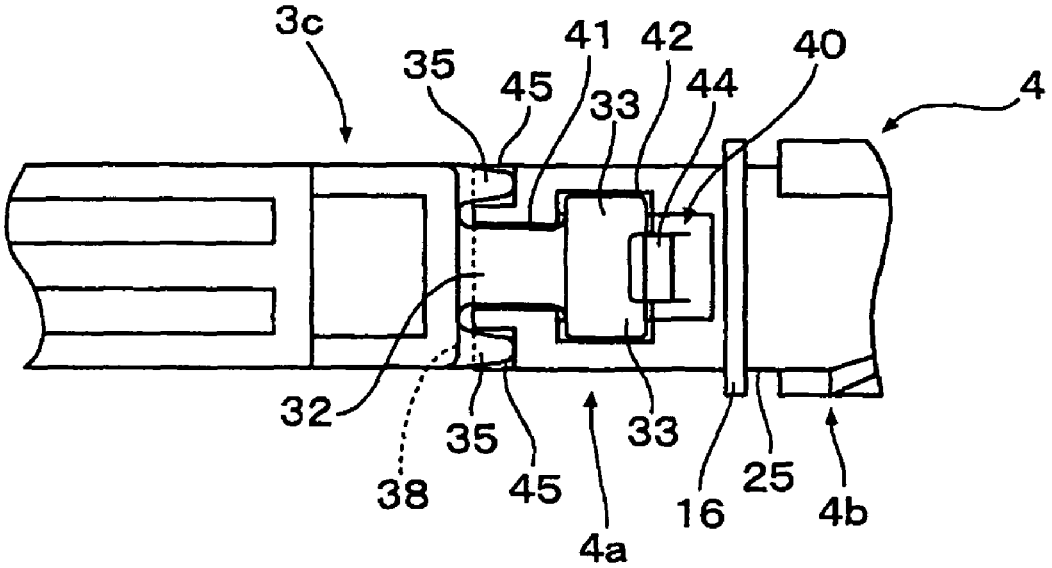

In this state, the post-like portion 32 and the double side projecting portions 33, 33 of the slide pin 3 are inserted into the axial recess portion 41 and the lateral recess portions 42, respectively, of the accommodation recess portion 40. Then, as is shown in FIGS. 8 to 9B, the elastic engagement piece 44 is deflected so as to receive the connecting end portion 3*c* of the slide pin 3, and when the connecting end portion 3*c* is pushed in completely, the locking claw portion 43 of the elastic engagement piece 44 is brought into engagement with the angular corner portion 34, whereby the connecting end portion 3*c* of the slide pin 3 is prevented from being dislocated with respect to the direction in which the connecting end portion is inserted. In addition, the double side projecting portions 33, 33 of the slide pin 3 are brought into abutment with inner circumferences of the lateral recess portions 42 of the accommodation recess portion 40, whereby the connecting end portion 3*c* of the slide pin 3 is also prevented from being dislocated in the axial direction. In this way, since the slide pin 3 can be assembled to the cam member 4 from a direction which is at right angles to the axial direction, good working properties can be provided in connecting the slide pin 3 to the cam member 4.

In addition, in this state, since the elastic engagement piece 44 presses the connecting end portion of the slide pin 3 in the axial direction, the double side projecting portions 33, 33 of the slide pin 3 are brought into press contact with the inner circumferences of the lateral recess portions 42 of the accommodation recess portion 40, the occurrence of looseness being thereby prevented.

Further, since the projecting portions 35, 35 of the slide pin 3 are inserted into the guide recess portions 45, 45 of the cam member 4, so that the projecting portions 35, 35 lie close to the end face of the cam member 4 in a confronting fashion in a position lying closer to a near side in the inserting direction of the slide pin 3 than the double side projecting portions 33, 33 of the slide pin, even in the event that the slide pin 3 is attempted to be bent upwards (in a direction indicated by an arrow A in FIG. 9A) relative to the cam member 4, the projecting portions 35, 35 of the slide pin 3 are brought into abutment with the end face of the cam member 4, the bending of the slide pin 3 being thereby prevented. In addition, in the event that the slide pin 3 is attempted to be bent downwards (in a direction indicated by an arrow B in FIG. 9A) relative to the cam member 4, the ribs 38, 38 are brought into abutment with the end face of the cam member 4, the bending of the slide pin 3 being thereby prevented. In addition, by the projecting portions 35, 35 and the ribs 38, 38 being brought into abutment with the end face of the cam member 4, the occurrence of looseness in the connecting portion can be prevented more effectively.

Further, the projecting portions 35, 35 of the slide pin 3 function to prevent the expansion of both side walls of the accommodation recess portion 40. Because of this, for example, even though the length of the double side projecting portions 33, 33 of the slide pin 3 in the width direction is made slightly larger than the width of the lateral recess portions 42 so that the double side projecting portions 33, 33 are press fitted in the lateral recess portions 42, since the expansion of both the side walls of the lateral recess portions 42 are prevented, the slide pin 3 can be made to be held firmly without looseness.

In addition, although the slide pin 3 needs to be assembled in such a manner that the tapered surface at the distal end thereof is oriented towards the front surface side of the operation handle 1, even though the slide pin 3 is inserted upside down with the projecting portions 35, 35 placed downwards as a result of taking wrong the inserting direction, since the guide recess portions 45, 45 are formed to extend downwards only to the intermediate position in the inserting direction of the slide pin 3, the slide pin 3 cannot be assembled to the cam member 4, thereby making it possible to prevent the erroneous assemblage.

Figure 10:
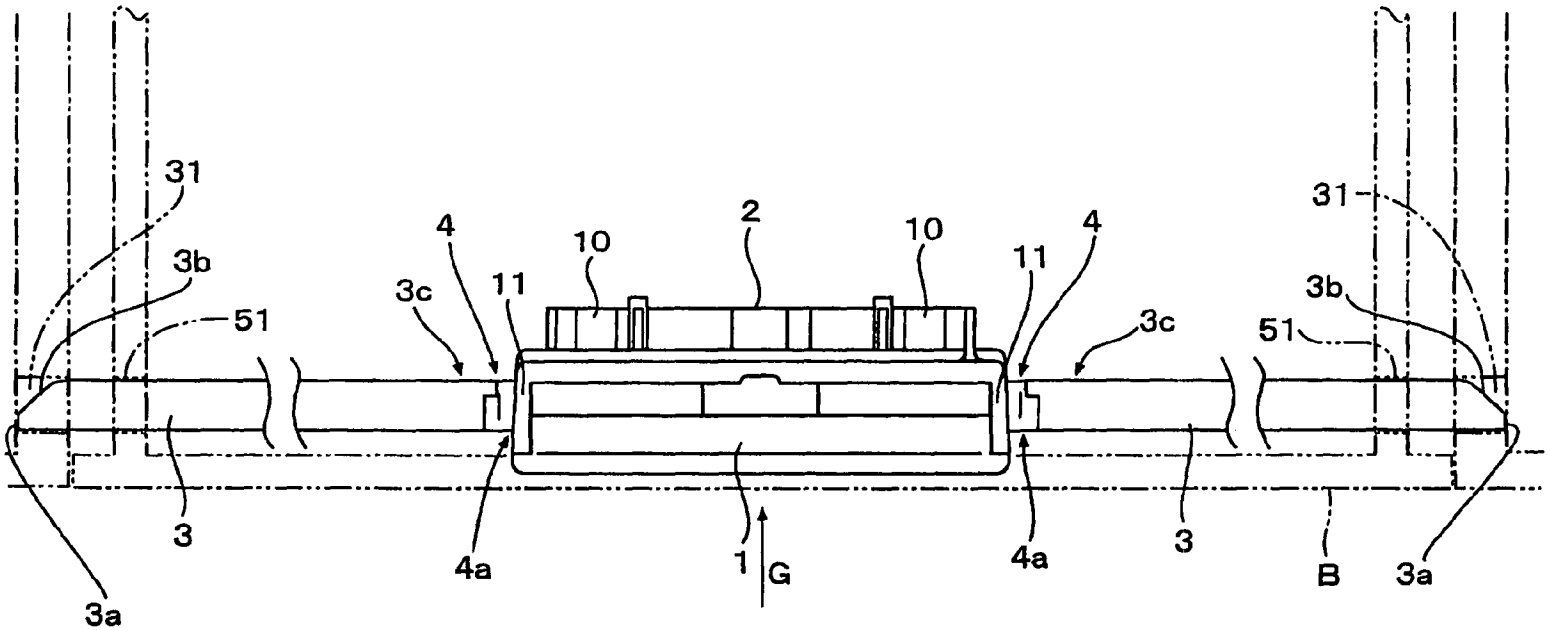
FIG. 10 is an explanatory diagram depicting a state in which the lock system is installed on a glove box and is locked.
Figure 11:
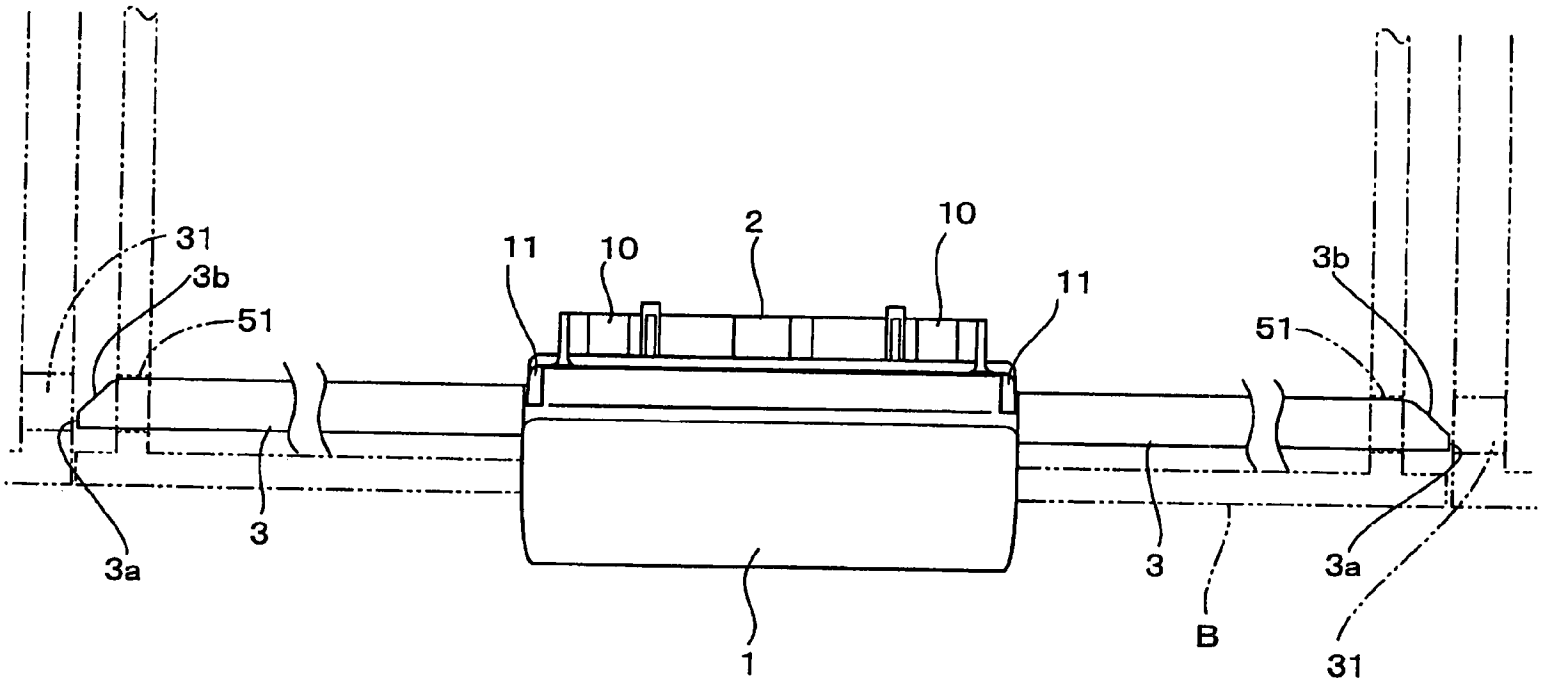
FIG. 11 is an explanatory diagram depicting a state in which the lock system is installed on the glove box and is unlocked.
Figure 12:
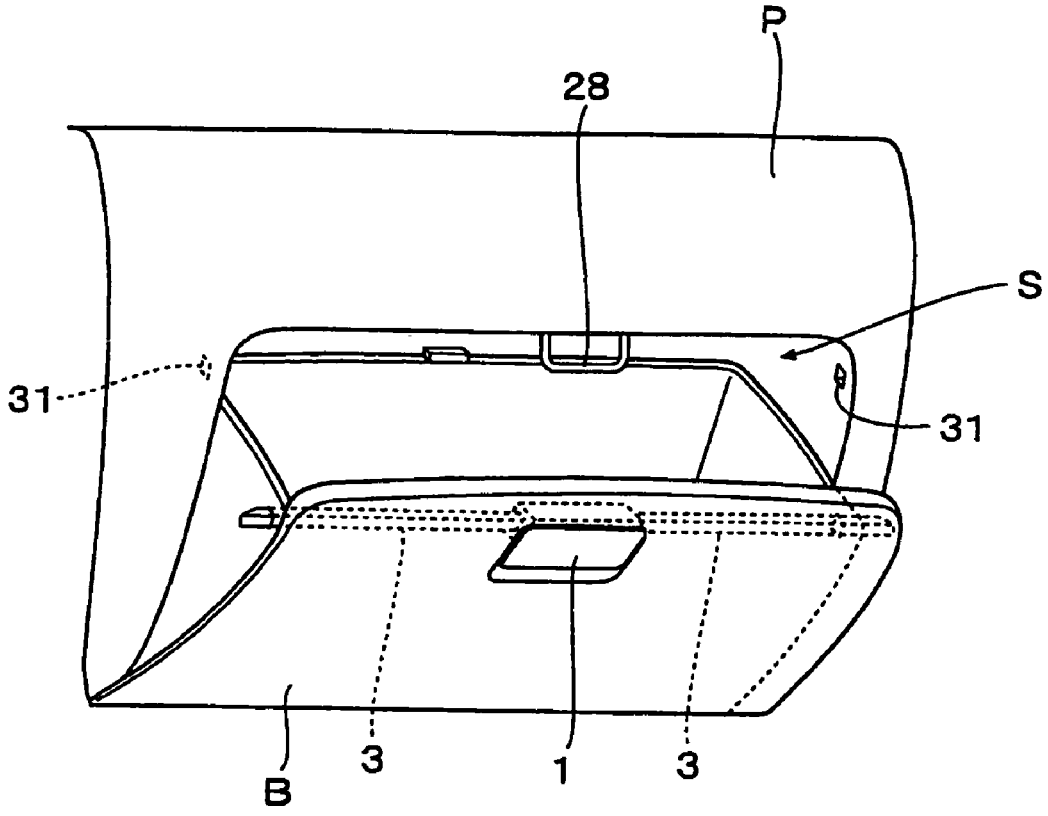
FIG. 12 is a perspective view depicting the glove box to which the lock system is applied.

FIGS. 10 and 11 show a state in which the slide pins 3 are connected to the cam members 4 in the way described above and the slide pins 3 and the cam members 4 so connected together are mounted on the glove box B.

Namely, as is shown in FIG. 10, in such a state that the operation handle 1 is not operated to swing, the pair of left and right slide pins 3 are caused to extend by virtue of the biasing spring pressure of the compression coil springs 5 so as to enter the lock holes 31, 31 in the instrument panel P for engagement from passage holes 51 formed in lateral surfaces of the glove box B, whereby the glove box B is locked in a closed state.

In addition, when unlocking the locked state, in the event that the operation handle 1 is gripped to be pulled up, the first raised portions 7 within the cylindrical portions 6 which move while linking with the swing of the operation handle 1 move along the oblique side groove edges of the corresponding cam grooves 20 so that the cam members 4 are caused to be pulled into the interiors of the cylindrical portions 6. Therefore, as is shown in FIG. 11, the distal end portions of the respective slide pins 3 are caused to retreat from the lock holes 31 in the instrument panel P, whereby the glove box B is permitted to rotate in a direction in which it is opened.

In addition, as this occurs, when the operator release his or her hand from the operation handle 1, the restraint of the first raised portions 7 of the cylindrical portions 6 which move as a result of being linked with the operation handle 1 by the cam grooves 20 is released, and the operation handle 1 attempts to swing abruptly in an opposite direction together with the cylindrical portions 6 by virtue of the spring pressures of the compression coil springs 5 with a force, and at the same time, the slide pins 3 are subjected to the biasing spring pressures of the compression coil springs 5 and also attempt to project abruptly towards the lock holes 31 with a force. In this embodiment, however, since the O rings 24 are provided between the inner surfaces of the cylindrical portions 6 of the operation handle 1 which configure the outer cylindrical members and outer surfaces of the cam side end portions of the cam members 4 which configure the inner cylindrical members so as to be brought into sliding contact therewith at the same time, the operation handle 1 swings slowly towards a non-operation position due to the sliding resistance (the braking force) of the O rings 24, whereby the stoppers for regulating the projecting amount of the slide pins 3, that is, the operation handle 1 and the support frame 2, in this embodiment, are prevented from being caused to collide strongly with each other. Consequently, since a fear of generation of a large colliding sound is suppressed sufficiently which was inherent in the related art, there can be eliminated concern that the colliding sound makes the operator to think of a failure of the lock system, giving him or her a sensation of unreliability or uncomfortableness.

On the contrary, in the case of the opened glove box B being closed, the glove box B is caused to rotate in a closing direction. As this occurs, the tapered surfaces 3*b* at the distal end portions of the respective slide pins 3 which are projecting towards the corresponding lock holes 31 are brought into abutment with the wall surfaces of the instrument panel P, whereby the distal end portions of the respective slide pins 3 are caused to once retreat in a straight-line fashion and then pass through the wall surfaces to eventually enter the lock holes 31 in the instrument panel P for engagement therewith by virtue of the biasing spring pressures of the compression coil springs 5, and therefore, the glove box B is locked in the closed state described above.

As this occurs, since the first raised portions 7 of the cylindrical portions 6 move rectilinearly within the corresponding cam grooves 20 so that the cam members 4 are pulled into the interiors of the cylindrical portions 6, when the slide pins 3 enter the corresponding lock holes 31, this time, the slide pins 3 are subjected to the biasing spring pressures of the compression coil springs 5 and attempt to project abruptly towards the lock holes 31 with a force. However, as with the case described above, since the O rings 24 reside between the inner surfaces of the cylindrical portions 6 of the operation handle 1 and the outer surfaces of the cam side end portions 4*b* of the cam members 4 so as to be in sliding contact therewith at the same time, the cam members 4 project slowly towards the lock holes 31 within the cylindrical portions 6 due to the sliding resistance of the O rings 24, whereby the stoppers for regulating the projecting amounts of the cam members 4, that is, in this embodiment, the cam grooves 20 and the first raised portions 7 are prevented from being caused to collide against each other strongly. Consequently, in this case, too, since a fear of generation of a large colliding sound is suppressed sufficiently, there can be eliminated concern that the colliding sound makes the operator to think of a failure of the lock system, giving him or her a sensation of unreliability or uncomfortableness.

Next, referring to FIGS. 13A to 17, a second embodiment of the invention will be described. It should be noted that like reference numerals will be given to substantially like portions to those of the embodiment that has been described above, so that the description thereof will be omitted here.

This embodiment differs from the first embodiment in a connecting construction between slide pins 3 and cam members 4, and the other portions are substantially the same as those of the first embodiment. Then, in the following description, different features of the connecting construction will be described.

Figure 13A:
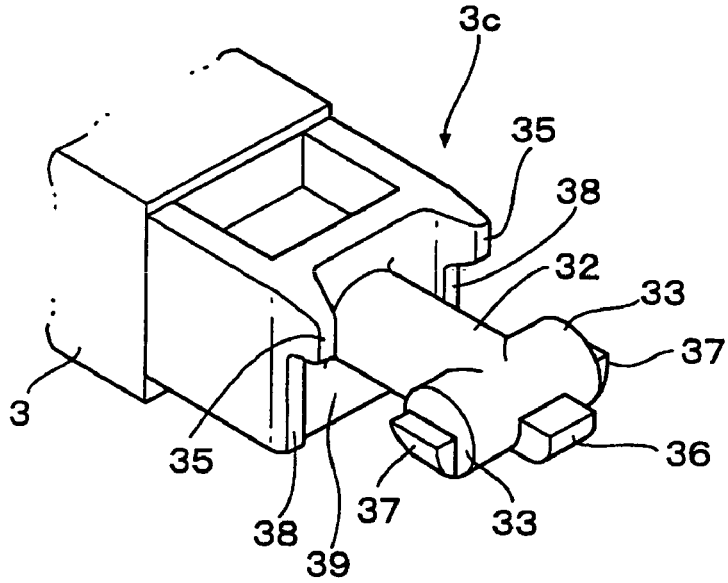
Figure 13B:
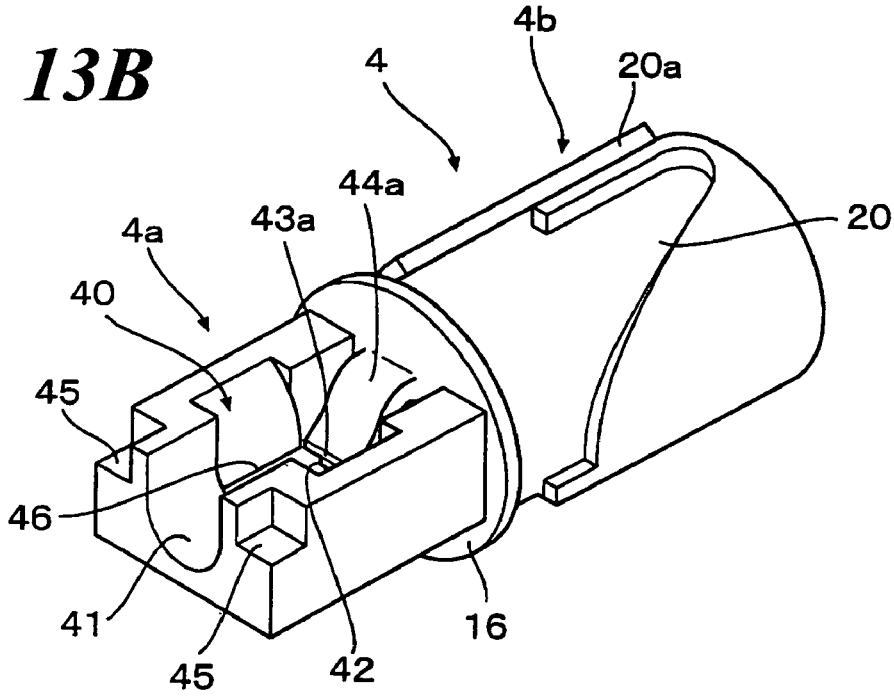
Figure 14A:
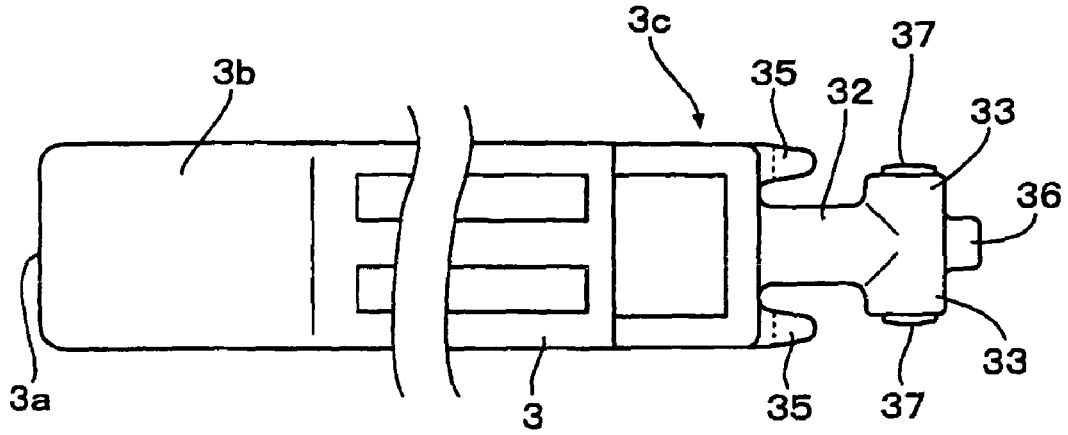
Figure 14B:
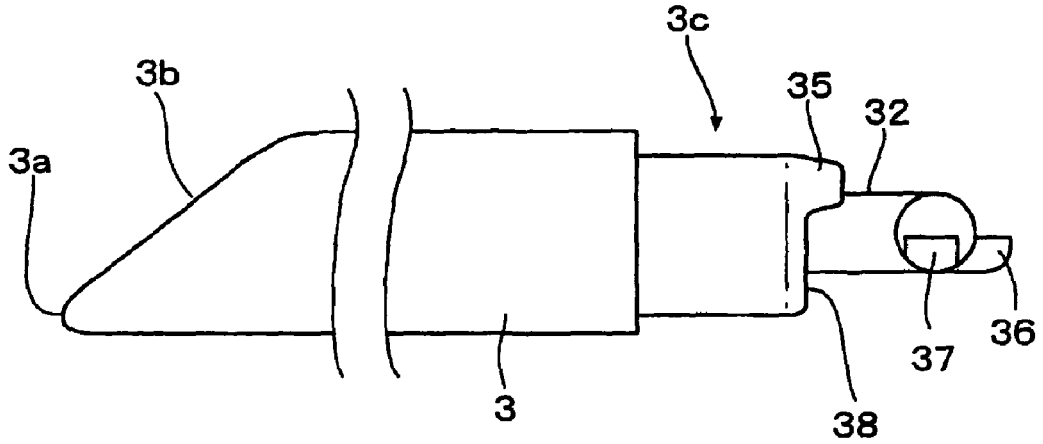
Figure 15A:
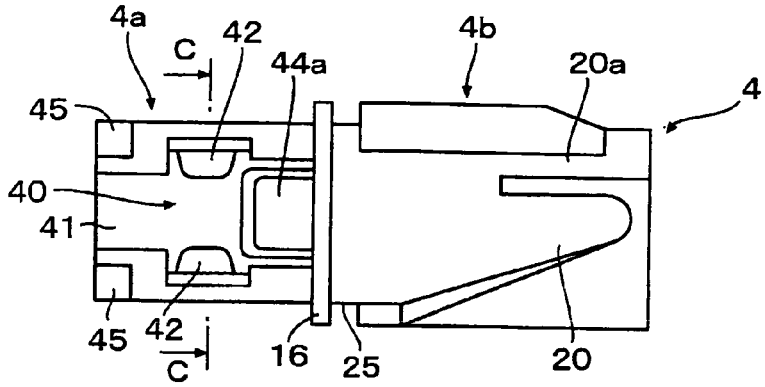
Figure 15B:
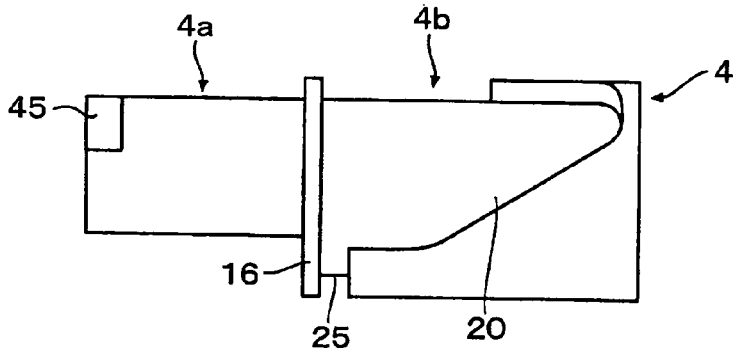
Figure 15C:
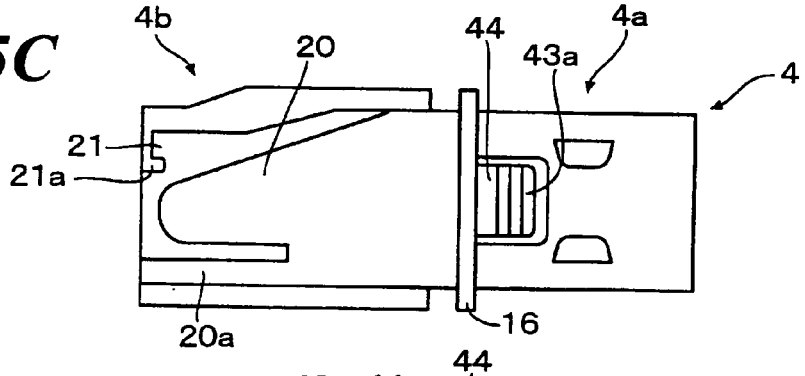
Figure 15D:
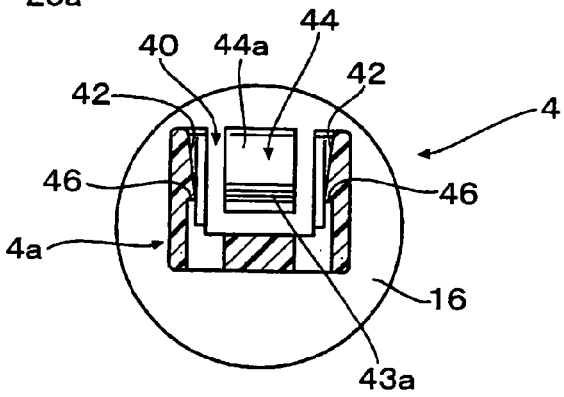
Figure 16A:
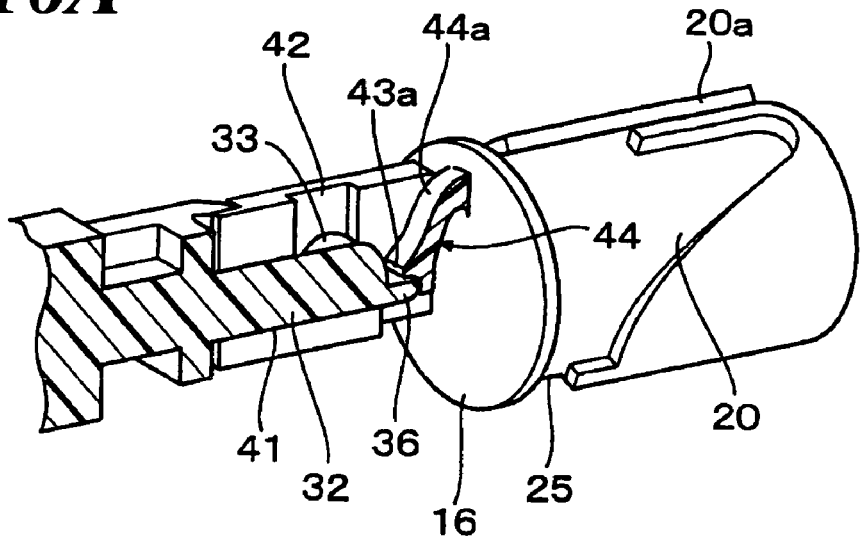
Figure 16B:
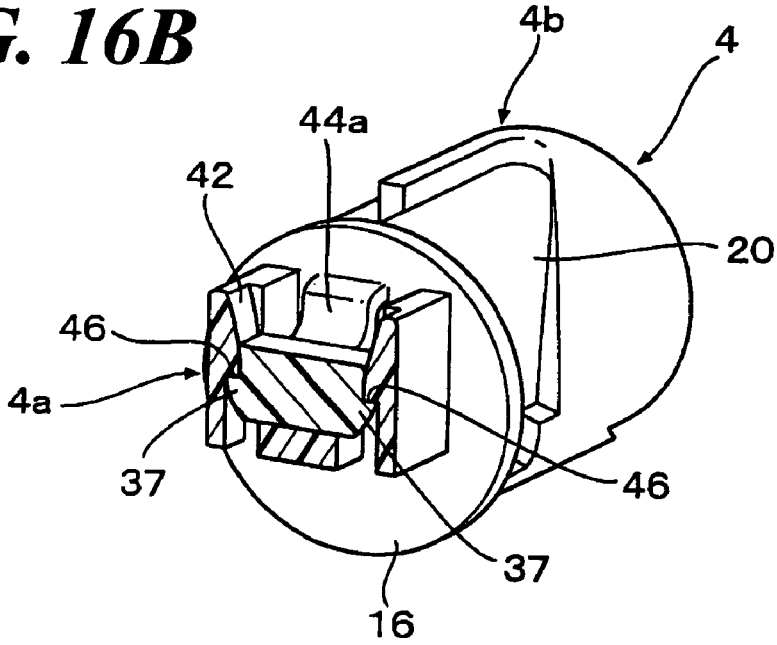

As is shown in FIGS. 13A, 14A and 14B, a post-like portion and double side projecting portions 33, 33 are formed at a connecting end portion 3*c* of a slide pin 3. In addition, at a distal end of the post-like portion 32 in the axial direction, a distal end projection 36 which is situated in a position offset to a side from which the slide pin 3 is inserted into an accommodation recess 40 of a cam member 4, in other words, when viewing from the side, in a lower position than the center of the double side projecting portions 33, 33, is formed to further project in the axial direction.

In addition, engagement projections 37 are formed individually on respective projecting end faces of the double side projecting portions 33, 33 of the slide pin 3 in positions which are offset to a side from which the slide pin 3 is inserted (a lower side as viewed in the figure).

Further, the pair of projecting portions 35, 35 are formed at upper portions at both sides of an end face 39 lying around the periphery of a proximal portion of the post-like portion 32 of the slide pin 3, and ribs 38, 38, which are shorter in height than the projecting portions 35, 35, are formed at portions lying below the projecting portions 35, 35.

On the other hand, as is shown in FIGS. 13B, 15A to 15D and 16A to 16B, as with the embodiment that has been described above, the accommodation recess portion 40 made up of an axial recess portion 41 and lateral recess portions 42 is formed in a connecting end portion 4*a* of the cam member 4. In addition, locking stepped portions 46 with which the engagement projections 37 of the slide pin 3 are brought into engagement are formed on inner surfaces of both the lateral recess portions 42. Upper portions of the locking stepped portions 46 configure tapered guide surfaces widened toward upwards.

In addition, an elastic engagement piece 44*a* is formed in an axial deeper position in the accommodation recess portion 40 into a shape projecting from a proximal end portion thereof connected to a deeper side end face of the accommodation recess portion and downwardly curving. In addition, a locking claw portion 43*a* is formed at a lower portion of the elastic engagement piece 44*a* so as to be brought into engagement with the distal projection 36 of the slide pin 3.

Consequently, when connecting the slide pin 3 to the cam member 4, the post-like portion 32 and the double side projecting portions 33, 33 of the slide pin 3 are inserted, respectively, into the axial recess portion 41 and the lateral recess portions 42, 42. Then, the engagement projections 37 which are formed on the end faces of the double side projecting portions 33 of the slide pin 3 are brought into engagement with the locking stepped portions 46 which are formed on the inner surfaces of the lateral recess portions 42 of the cam member 4. As this occurs, both the side walls of the accommodation recess 40 are fastened by the projecting portions 35, 35 of the slide pin 3 at upper portions thereof and hence, the expansion of the side walls is suppressed, and the engagement portions between the engagement projections 37 and the locking stepped portions 46 are situated further downwards than the portions which are fastened by the projecting portions 35, 35, whereby the engagement force of the engagement projections 37 and the locking stepped portions 46 is enhanced effectively. In addition, the distal end projection 36 of the slide pin 3 is brought into engagement with the locking claw portion 43*a* of the elastic engagement piece 43. In this way, the slide pin 3 is prevented from being dislocated with respect to the inserting direction thereof, and the double side projecting portions 33, 33 fit into the lateral recess portions 42, 42, whereby the slide pin 3 is also prevented from being dislocated in the axial direction to thereby be held firmly.

In addition, since the elastic engagement piece 44*a* presses the slide pin 3 in the axial direction in this state, the double side projecting portions 33, 33 are brought into press contact with the lateral recess portions 42, 42, the looseness of the slide pin 3 being thereby prevented.

Further, since the projecting portions 35, 35 of the slide pin 3 are inserted into the corresponding guide recess portions 45, 45 of the cam member 4 so as to be brought into abutment with inner surfaces thereof and the ribs 38, 38 lying below the projecting portions 35, 35 are also brought into abutment with the end face of the cam member 4, abutment surfaces of the slide pin 3 and the cam member 4 are brought into abutment with each other in upper and lower positions. Because of this, both the members are connected together with less looseness, and even in the event that a force which attempts to bend the slide pin in directions indicated by arrows A, B shown in FIG. 17, a strong resisting force is imparted.

Figure 17:
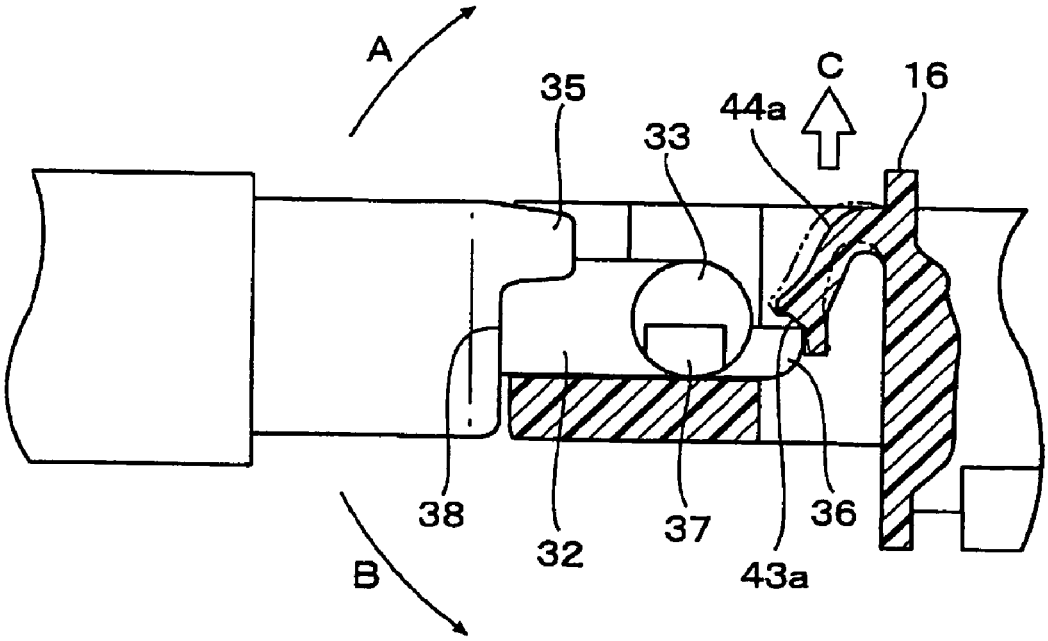
FIG. 17 is a partially enlarged sectional view depicting the connecting construction between the slide pin and the cam member of the lock system.

Furthermore, as is indicated by an arrow C in FIG. 17, when a force is exerted which attempts to dislocate the slide pin 3 from the accommodation recess portion 40 in the cam member 4, the elastic engagement piece 44*a* which is brought into engagement with the distal end projection 36 of the slide pin 3 at the locking claw portion 43*a* exhibits a shape which is bent downwards from above, a strong resisting force is exhibited.

Next, referring to FIGS. 18 to 22B, a third embodiment of the invention will be described. It should be noted that like reference numerals will be given to substantially like portions to those of the embodiments, so that the description thereof will be omitted here.

This third embodiment differs from the first embodiment and the second embodiment in a connecting construction between a slide pin and a cam member 4, and the other portions are substantially the same as those of the previous embodiments. Hereinafter, different features of the third embodiment from the other embodiments will mainly be described.

In this third embodiment, as with the other embodiments, the slide pin is formed into the shape in which a post-like portions 32 projects from a center of a connecting end portion 3*c* thereof and double side projecting portions 33, 33 project respectively from both sides of a distal end portion thereof.

Figure 18:
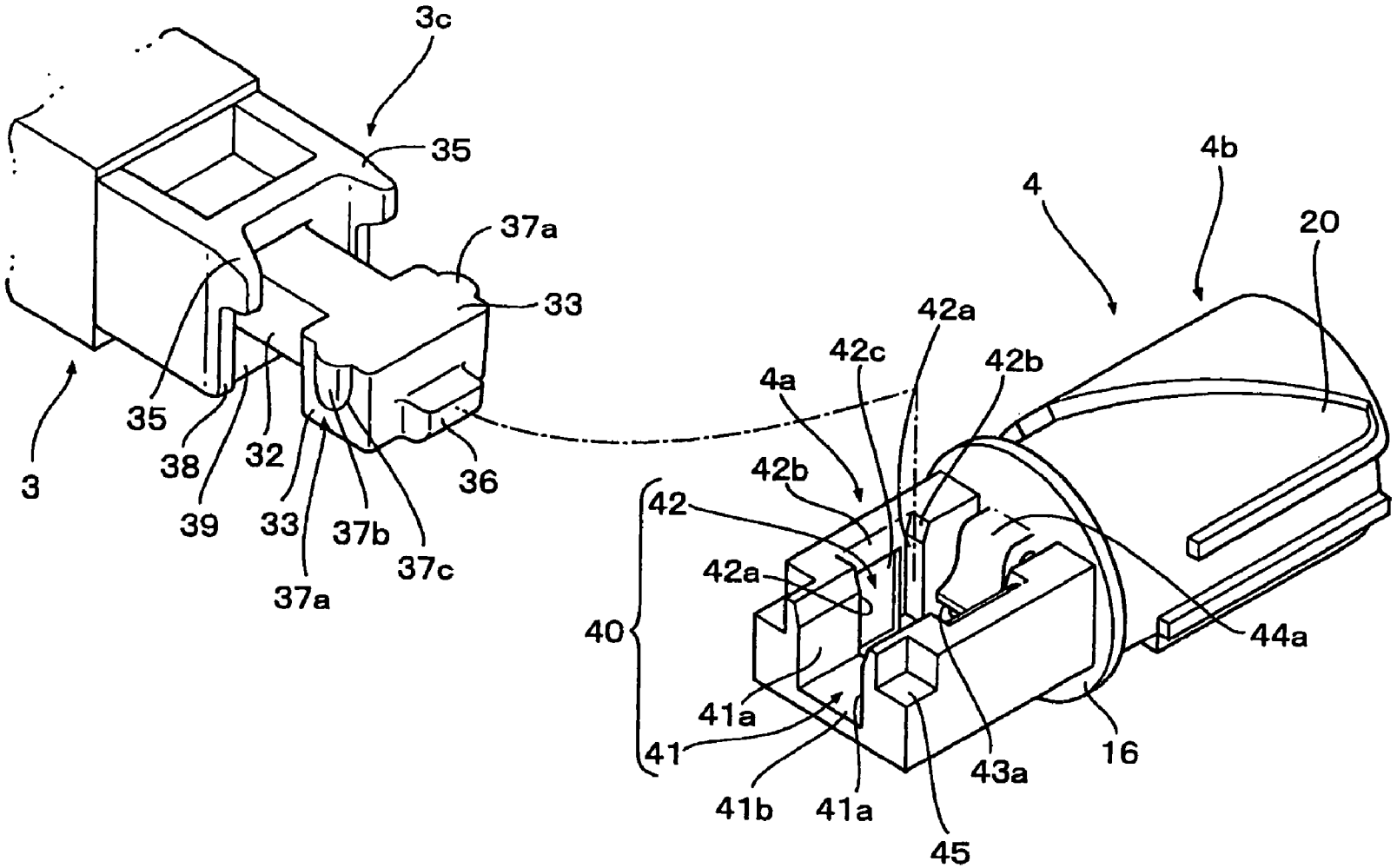
FIG. 18 is an enlarged perspective of a main part depicting a third embodiment of a lock system according to the invention.
Figure 19A:
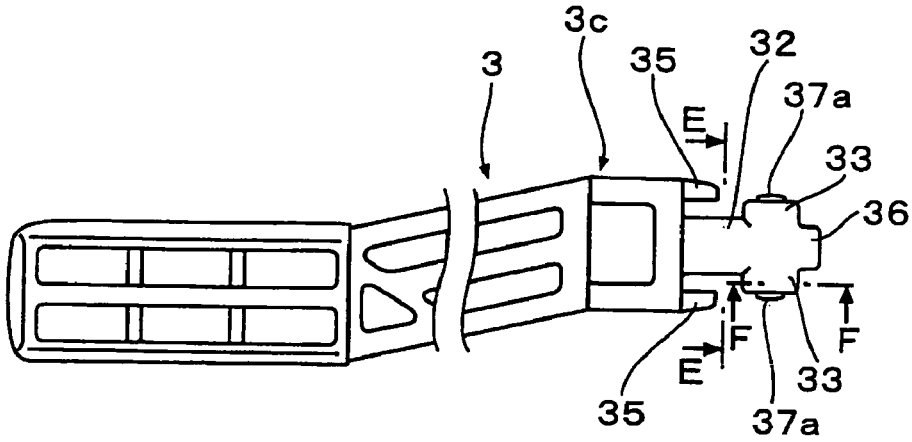
Figure 19B:
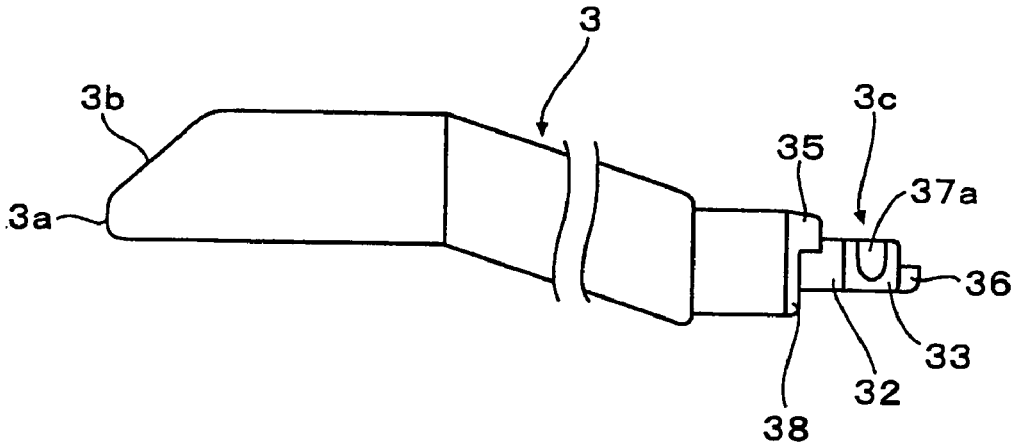
Figure 19C:
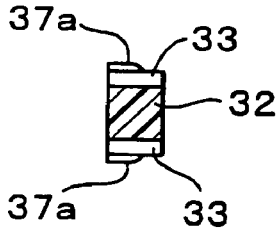
Figure 19D:
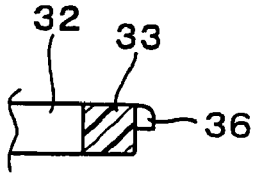

In addition, one of different features of the third embodiment from the other embodiments is the shape of the post-like portion 32 which projects from the center of the connecting end portion 3*c* of the slide pin 3. Namely, in contrast to the fact that the post-like portions 32 of the other embodiments have the circular cross section (refer to FIGS. 6A and 13A), the post-like portion 32 of the third embodiment has, as is shown in FIGS. 18 and 19C, an angular cross section. The post-like portion 32 of this embodiment has a quadrangular cross section.

Corresponding to the post-like portion 32 which has the angular cross section, an axial recess portion 41 of an accommodation recess portion 40 which configures a portion into which the post-like portion 32 is inserted to be supported in place therein has an inner circumferential surface to which at least one side of the post-like portion 32 is fitted. More specifically, as is shown in FIG. 18, the inner circumferential surface of the axial recess portion 41 has an angular groove shape which is made up of a pair of side surfaces 41*a*, 41*a* which are provided parallel to each other along a direction in which the connecting end portion 3*c* of the slide pin 3 is inserted and a bottom surface 41*b* which is provided so as to intersect the pair of side surfaces 41*a*, 41*a* at right angles.

Figure 7A:
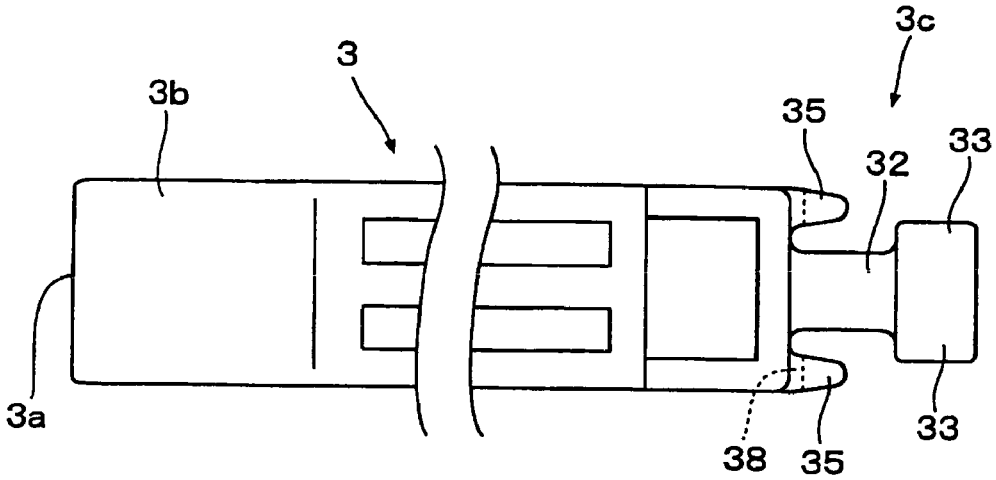
Figure 7B:
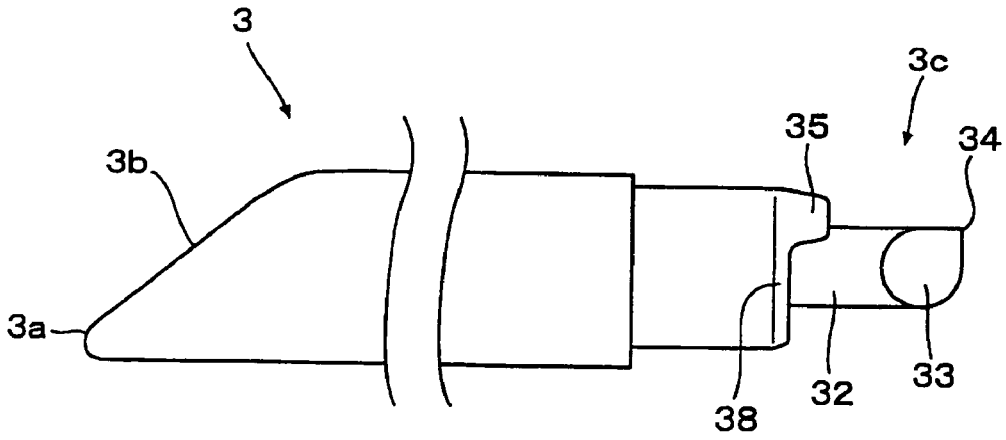

In addition, another different feature of the third embodiment from the other embodiments is the shape of the double side projecting portions 33, 33 which projects from both the sides of the distal end portion of the post-like portion 32. Namely, in contrast to the fact that the double side projecting portions 33, 33 of the first embodiment have, as is shown in FIGS. 6A and 7B, the cross section having the different diameters (the shape in which the angular corner portion is formed at one location on the outer circumference of the arc shape) and the double side projecting portions 33, 33 of the second embodiment have, as is shown in FIGS. 13A and 14B, the circular cross section, the double side projecting portions 33, 33 of the third embodiment have an angular cross section. The double side projecting portions 33, 33 of this embodiment have a quadrangular cross section.

Corresponding to the double side projecting portions 33, 33 which have the angular cross section described above, the lateral recess portions 42 of the cam member 4 in which the double side projecting portions 33, 33 are received, respectively, have inner circumferential surfaces to which at least single sides of the double side projecting portions 33, 33 are fitted. Specifically, on each of inner circumferential surfaces of the lateral recess portions 42, a groove is formed in a constant width along a direction in which the connecting end portion 3*c* of the slide pin 3 is inserted by a pair of lateral side surfaces 42*a*, 42*a* which are parallel to each other so as to extend from an opening to reach a bottom surface of the accommodation recess portion 40. In addition, a tapered surface 42*b* is formed at an inner circumferential edge of an opening side of the lateral recess portion 42 so as to be widened gradually towards the opening side, the inserting properties of the connecting end portion 3*c* of the slide pin 3 into the accommodation recess 40 being thereby enhanced.

Further, the other different feature of the third embodiment from the other embodiments is the shape and position of engagement projections 37*a*, 37*a* which are provided on projecting end faces of the double side projecting portions 33, 33 so as to project therefrom. Namely, in contrast to the fact that the respective engagement projections 37, 37 of the second embodiment are provided in the positions which are offset towards the side from which the connecting end portion 3*c* of the slide pin 3 is inserted into the accommodation recess portion 40 (the positions lying closer to the front of the inserting direction of the slide pin 3) (refer to FIG. 14B), the respective engagement projections 37*a*, 37*a* of the third embodiment are, as is shown in FIGS. 18 and 19B, formed on the respective end faces of the double side projecting portions 33, 33 in positions lying closer to the rear of the inserting direction of the slide pin 3 into the accommodation recess 40.

In addition, as is shown in FIGS. 18 and 19C, each engagement projection 37*a* projects highest at a central portion 37*b* thereof, and a circumferential edge portion 37*c* (a circumferential edge portion which expands in an axial direction of the lateral side projecting portion 33 and a circumferential portion which expands towards the front of the inserting direction of the slide pin 3 into the accommodation recess portion 40) of the central portion 37*b* is formed into a curved shape in which the height of engagement portion is gradually reduced as the curve extends away from the central portion 37*b*. By the provision of the circumferential edge portion 37*c* that is configured in the way described above, the insertion of the connecting end portion 3*c* of the slide pin 3 into the accommodation recess portion 40 in the cam member 4 is facilitated.

Figure 20A:
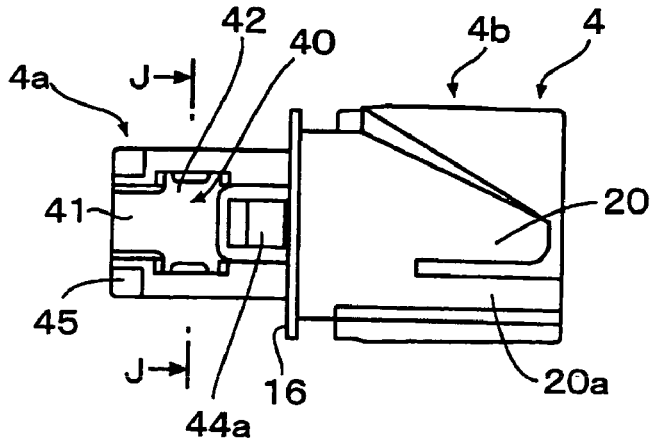
Figure 20B:
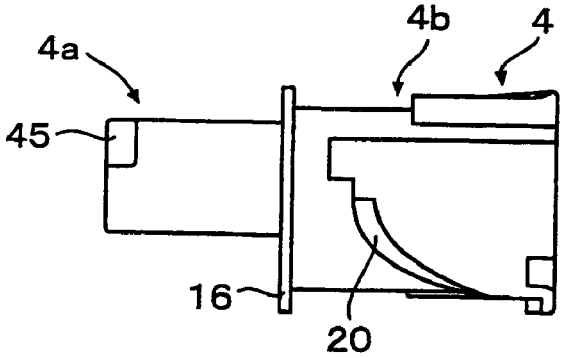
Figure 20C:
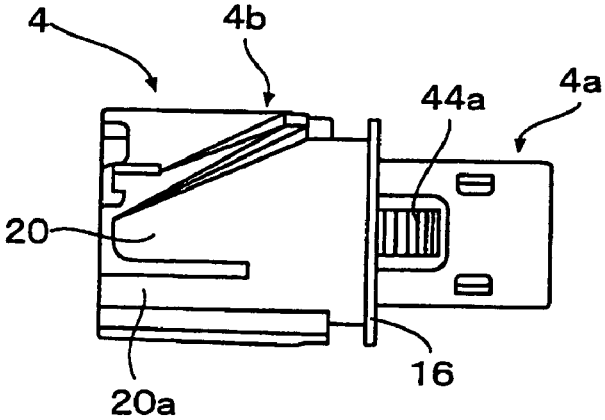
Figure 20D:
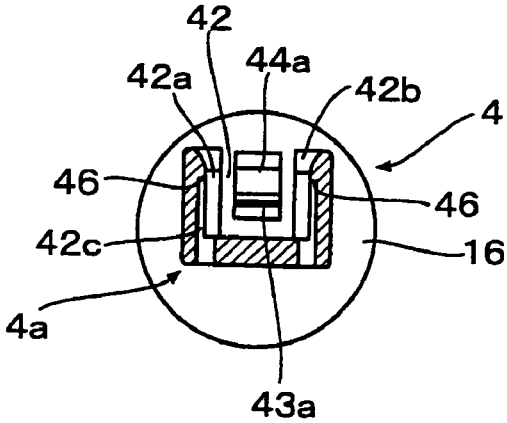
Figure 21A:
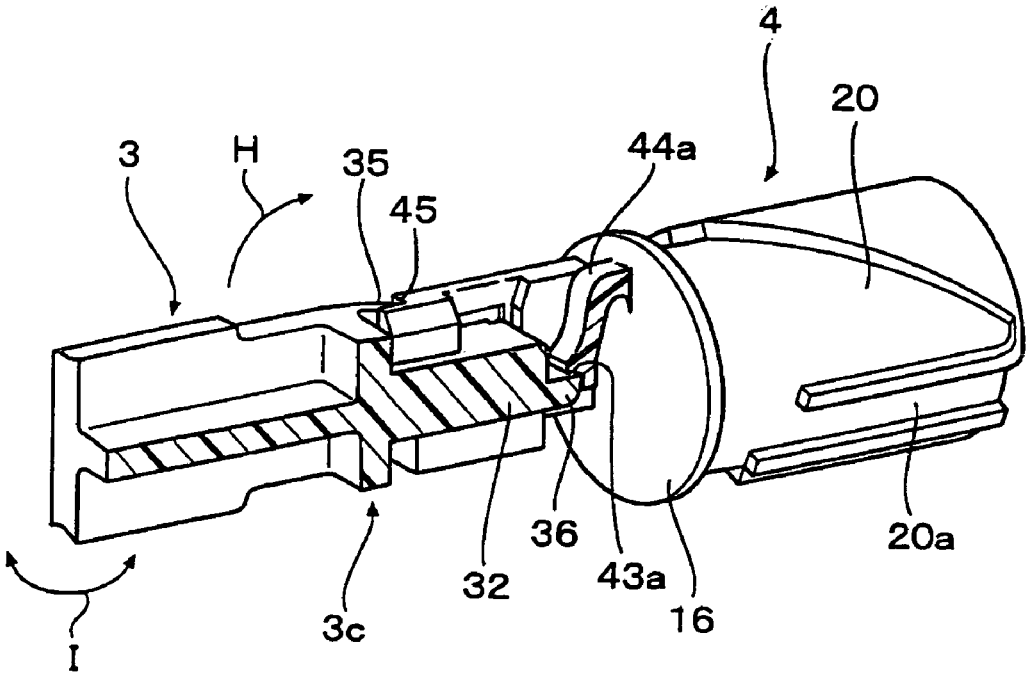
Figure 21B:
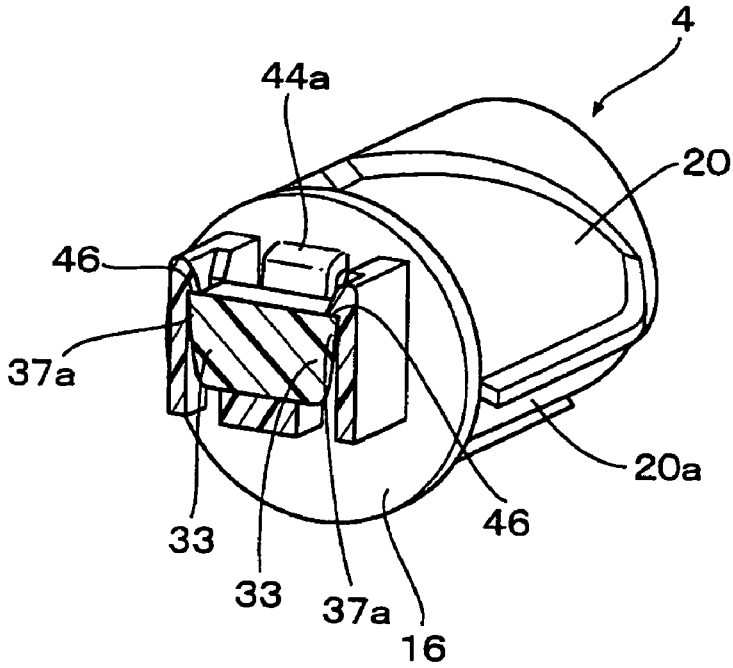

As is shown in FIGS. 18 and 20D, depressions 42*c*, 42*c* with a predetermined depth are provided individually on lateral side portions of both the lateral recess portions 42 of the accommodation recess portion 40, and inner wall surfaces of the respective depressions 42*c* which are situated closer to the rear of the inserting direction of the slide pin 3 configure locking stepped portions 46, 46 with which the engagement projections 37*a*, 37*a* are brought into engagement. In addition, since the engagement projections 37*a* which are brought into the corresponding locking stepped portions 46, 46 are formed closer to the rear of the inserting direction of the slide pin 3 into the accommodation recess 40, the respective locking stepped portions 46, 46 are provided closer to the rear of the inserting direction of the slide pin 3 compared with the locking stepped portions 46 of the second embodiment (refer to FIG. 15C).

Further, in the third embodiment, the shape of an elastic engagement piece 44*a* provided in the accommodation recess portion 40 of the cam member 4 differs slightly from the elastic engagement piece 44*a* of the second embodiment. Namely, while the elastic engagement piece 44*a* of the second embodiment has the curved shape in which the elastic engagement piece 44*a* is curved downwards from the deeper side end face of the accommodation recess portion 40 (refer to FIG. 13B), the elastic engagement piece 44*a* of the third embodiment has a shape in which the elastic engagement piece 44*a* extends a predetermined length in the axial direction from a deeper side end face of the accommodation recess portion 40 (that is, an end face of a flange portion 16 at a side of an accommodation recess portion 40) and is then curved downwards therefrom, that is, the elastic engagement piece 44*a* slightly projects more inside the accommodation recess portion 40. By adopting a shape like this, when the connecting end portion 3*c* is inserted into the accommodation recess portion 40, the abutment of the distal end projection 36 with the elastic engagement piece 44*a* is facilitated so that the distal end projection 36 is pressed against the elastic engagement piece 44*a* strongly, whereby the elastic engagement piece 44*a* can be made to be deflected more easily.

Next, in the lock system of the third embodiment, connecting work of the slide pin 3 to the cam member 4 will be described.

Namely, as with the other embodiments, the post-like portion 32 and the double side projecting portions 33, 33 of the slide pin 3 are aligned with and inserted into the axial recess portion 41 and the lateral recess portions 42, 42, respectively, of the accommodation recess portion 40 of the cam member. Then, the engagement projections 37, 37 enter the corresponding depressions 42*c*, 42*c* on both the sides of the lateral recess portions 42 so as to be brought into engagement with the corresponding locking stepped portions 46, 46, while the distal end projection 36 of the slide pin 3 is brought into engagement with the locking claw portion 43*a* of the elastic engagement piece 44*a* of the cam member 4. Thus, the slide pin 3 is prevented from being dislocated with respect to the inserting direction thereof, and the double side projecting portions 33, 33 are fitted in the corresponding lateral recess portions 42, 42, whereby the slide pin 3 is also prevented from being dislocated in the axial direction, and the slide pin 3 is held firmly.

Incidentally, when a force is exerted on the lid element of the glove box B which closes the accommodation space S in the instrument panel P as is indicated by an arrow G in FIG. 10 as a result of an impact is applied to the vehicle including the lock system from the outside thereof, for example, a force acting in an opposite direction to the inserting direction of the slide pin 3 into the accommodation recess portion 40 (refer to an arrow H in FIGS. 21A and 21B) is exerted on the slide pins 3, leading to a fear that the slide pins 3 are dislocated.

In addition, in the event that the integrity between the slide pin 3 and the cam member 4 is insufficient due to looseness occurring between the slide pin 3 and the cam member 4 or in sufficient rigidity at the connecting portion, the following problems will be caused. For example, there is a possibility that abnormal noise is generated due to chattering vibrations. In addition, a positioning error is generated between the slide pin 3 and the cam member 4, whereby there is produced a situation in which a distal end portion 3*a* of the slide pin 3 is offset from the corresponding lock hole 31 and is prevented from entering the lock hole 31 firmly, causing the entering depth of the distal end portion 3*a* into the lock hole 31 to vary, or the projecting amounts of the distal end portions 3*a*, 3*a* of both the slide pins 3 in which the slide pins 3 projects from left and right passage holes 51, 51 (refer to FIG. 10) are caused to differ. As a result, even when the operation handle 1 is operated, the distal ends 3*a* of the slide pins 3 remain in the lock holes 31, whereby the lock cannot be unlocked. On the contrary, even though the glove box B is closed, the distal end portions 3*a* of the slide pins 3 are not brought into engagement with the lock holes 31, whereby the glove box B cannot be locked. Further, only one of the distal end portions 3*a* of the left and right slide pins 3, 3 is kept engaged with the lock hole 31 or prevented from being brought into engagement therewith, leading to a fear that the opening and closing operations of the lock system become unstable.

However, in the third embodiment, as is indicated by the arrow H, when the force is exerted in the direction in which the slide pin 3 is dislocated from the accommodation recess portion 40, the lateral side surfaces lying along the inserting direction of the double side projecting portions 33, 33 which each have the quadrangular cross section are made to be brought into abutment with the lateral side surfaces 42*a*, 42*a* of the lateral recess portions 42. Namely, in this third embodiment, since at least the single sides of the respective double side projecting portions 33, 33 which each have the angular cross section are made to fit in the inner surfaces of the lateral recess portions 42 so as to be brought into abutment therewith, the looseness of the slide pin 3 can be suppressed, so that the slide pin 3 can be held with high rigidity relative to the cam member 4, whereby the dislocation of the slide pin 3 from the accommodation recess 40 can be prevented in an ensured fashion. In addition, the chattering vibrations attributed to looseness can be prevented so that abnormal noise can be suppressed, and the integrity between the slide pin 3 and the cam member 4 can be enhanced, whereby the engaging and disengaging operations of the slide pin 3 relative to the support structure (the instrument panel P) when the operation handle 1 is moved are made smooth.

Further, since the double side projecting portions 33, 33 of the slide pin 3 are made to have the angular cross section, the abutment area between the inner surfaces of both the lateral side portions of the accommodation recess portion 40 and the double side projecting portions 33, 33 of the slide pin is increased, as a result of which the contact surface pressure of the double side projecting portions 33, 33 against the accommodation recess portion 40 can be reduced. Because of this, even though sliding operations are repeated between the double side projecting portions 33, 33 of the slide pin 3 and the accommodation recess portion 40 of the cam member 4 as a result of the opening and closing operations of the glove box B being repeated, wear of the double side projecting portions 33, 33 of the slide pin 3 and the accommodation recess portion 40 of the cam member 4 can be reduced. By this, the advantages can be exhibited for a long period of time which include the prevention of dislocation of the slide pin 3 from the accommodation recess portion 40, prevention of chattering vibration, suppression of abnormal noise and enhancement of the integrity between the slide pin and the cam member.

In addition, in the third embodiment, since the engagement projections 37*a* of the slide pin 3 are formed on the respective end faces of the double side projecting portions 33, 33 in the positions lying closer to the rear of the inserting direction of the slide pin 3 into the accommodation recess portion 40, the locking stepped portions 46 which are brought into engagement with the corresponding engagement projections 37*a* of the slide pin 3 can be provided in the positions lying closer to the rear of the inserting direction of the slide pin 3. As a result, the locking stepped portions 46 which are provided on the inner surfaces of the lateral recess portions 42 of the accommodation recess portion 40 are made to be deflected outwards easily, the pushing force required when the connecting end portion 3*c* of the slide pin 3 into the accommodation recess 40 can be reduced, thereby making it possible to enhance the assembling properties in assembling the slide pin 3 into the accommodation recess portion 40.

Incidentally, there may happen a situation in which a force is exerted on the slide pin 3 connected to the cam member 4 which attempts to rotate the slide pin 3 relative to the cam member 4. As this occurs, the respective lateral sides of the post-like portion 32 which has the quadrangular cross section are made to be brought into abutment with the lateral side surfaces 41*a*, 41*a* and the bottom surface 41*b* of the axial recess portion 41 which is formed into the angular groove. Namely, in this third embodiment, in the event that a force is exerted on the slide pin 3 which attempts to rotate the slide pin 3 relative to the cam member 4, since at least one side of the post-like portion 32 of the slide pin 3 which has the angular cross section is fitted to the inner circumferential surface of the axial recess portion 41 of the cam member 4 for abutment therewith, the rotation of the slide pin 3 is prevented. By this action, the looseness of the slide pin 3 in the direction in which the slide pin 3 is attempted to be rotated can be suppressed so that the slide pin 3 can be held in the cam member 4 with high rigidity, thereby making it possible to enhance the integrity between the slide pin 3 and the cam member 4.

In addition, in the first to third embodiments, while the cam grooves 20 are described as being configured to have the right-angled triangle-like shape, since the transformation of the swinging motion of the operation handle 1 in the normal utilization conditions into the straight-line motion of the slide pin 3 is provided by the sliding of the first raised portions 7 along the stepped portions 22 which make up the oblique sides of the right-angled triangles, in the event that the cam member 4 has a stepped surface with any angles other than those parallel to or intersecting the swing axis at right angles, the same function and advantage as those of the first to third embodiments can be obtained. In this case, a longitudinal shape of the stepped surface may take the form of a straight line, a curve or a free curve, and in the event that a straight line connecting both end point positions at the shortest distance is other than parallel or at right angles to the swing axis, the invention can be carried out.

In addition, in the first to third embodiments, while the configuration is described in which the cam member 4 is inserted into the interior of the cylindrical portion 6 of the operation handle 1 and the whole outer surface of the O ring 24 is brought into sliding contact with the inner surface of the cylindrical portion 6, even in the event that the cylindrical portion 6 is formed not into a complete cylindrical shape but into a shape like a semi-cylindrical shape which includes partially a cylindrical inner surface, so that the partial cylindrical inner surface is made to be brought into sliding contact with part of the outer surface of the O ring 24, the invention can be carried out.

Additionally, in the first to third embodiments, while the configuration is described in which the swinging axis of the operation handle 1 and the straight-line motion axis of the slide pin 3 are made coaxial, in order to increase the degree of freedom in design, the swinging axis of the operation handle 1 and the straight-line motion axis of the slide pin 3 can be disposed parallel to each other, and as this occurs, by adopting a configuration in which the cam member 4 and the slide pin 3 are linked via a connecting rod or the like, the invention can be carried out. In this case, too, since the swinging motion of the operation handle 1 can be transformed into the straight-line motion of the slide pin 3, the same function and advantage as those of the first to third embodiments can be obtained.

Further, from the same reason, the swinging axis of the operation handle 1 and the straight-line motion axis of the slide pin 3 can be disposed so as to intersect each other at right angles, and as this occurs, in place of the motion transforming mechanism made up of the cam grooves 20 and the first raised portions 7, a rack and pinion mechanism or a piston crank mechanism can be adopted as the motion transforming mechanism.

In addition, in the third embodiment, while the cross sectional shapes of the post-like portion 32 and the double side projecting portions 33, 33 are formed into the quadrangular shapes, they may be other angular shapes such as, for example, a pentagonal shape and a hexagonal shape. In addition, the post-like portion 32 and the double side projecting portions 33, 33 may have a partially angular shape in which both lateral side surfaces are parallel flat surfaces, a bottom surface is a flat surface which is vertical to the lateral side surfaces, and an upper surface is made up of a curved surface. In this invention, a shape defined by the expression that the cross section is made into an angular shape may be any shape in which at least one angular corner portion is provided as has been described above and which has at least two planes which intersect each other via this angular corner portion. In addition, the lateral recess portions and the axial recess portion of the cam member may have on the inner circumferences thereof a flat surface which fits to at least one of the flat surfaces of the post-like portion 32 and the double side projecting portions 33, 33 which have the angular cross sections.

The invention claimed is:

1. A lock system comprising:

a support structure including a storage space;

a lid element pivotally supported to rotate on the support structure so as to close the storage space;

a slide pin supported on the lid element so as to be axially movable, the slide pin including one end to be engaged with and disengaged from the support structure, and an other end;

a spring member that biases the slide pin so as to be locked on the support structure;

an operation handle pivotally supported on the lid element;

a cylindrical portion connected to the operation handle;

a cam member including one end inserted into the cylindrical portion and an other end connected to the other end of the slide pin; and a cam mechanism provided between the cylindrical portion and the cam member to transform a swinging motion of the operation handle into an axial movement of the slide pin, wherein the other end of the slide pin includes:

a post portion projecting in an axial direction of the slide pin; and double lateral projecting portions projecting to both sides from the post portion so as to form an edge on the other end of the slide pin; and wherein the other end of the cam member includes:

an axial recess portion configured to open so as to receive the post portion along an insertion direction which is perpendicular to the axial direction;

lateral recess portions formed by extending a width of the axial recess portion at a lengthwise intermediate position thereof to receive the double lateral projecting portions to thereby restrict movement of the slide pin in the axial direction; and an elastic engagement piece provided inside the axial recess portion to be brought into engagement with a distal end of the slide pin to thereby urge the slide pin in the axial direction and restrict a movement of the slide pin in the insertion direction.

2. A lock system comprising:

a support structure including a storage space;

a lid element pivotally supported to rotate on the support structure so as to close the storage space;

a slide pin supported on the lid element so as to be axially movable, the slide pin including one end to be engaged with and disengaged from the support structure, and an other end;

a spring member that biases the slide pin so as to be locked on the support structure;

an operation handle pivotally supported on the lid element;

a cylindrical portion connected to the operation handle;

a cam member including one end inserted into the cylindrical portion and the other end connected to the other end of the slide pin; and a cam mechanism provided between the cylindrical portion and the cam member to transform a swinging motion of the operation handle into an axial movement of the slide pin, wherein the other end of the slide pin includes:

a post portion projecting in an axial direction of the slide pin; and double lateral projecting portions projecting to both sides from the post portion so as to form an edge on the other end of the slide pin, and wherein the other end of the cam member includes:

an axial recess portion configured to open so as to receive the post portion along an insertion direction which is perpendicular to the axial direction;

lateral recess portions formed by extending a width of the axial recess portion at a lengthwise intermediate position thereof to receive the double lateral projecting portions to thereby restrict a movement of the slide pin in the axial direction; and locking stepped portions formed on inwardly-facing sides of the lateral recess portions to be brought into engagement with the double lateral projecting portions to thereby restrict a movement of the slide pin in the insertion direction.

3. A lock system comprising:

a support structure including a storage space;

a lid element pivotally supported to rotate on the support structure so as to close the storage space;

a slide pin supported on the lid element so as to be movable, the slide pin including one end to be engaged with and disengaged from the support structure, and an other end;

a spring member that biases the slide pin so as to be locked on the support structure;

an operation handle pivotally supported on the lid element;

a cylindrical portion connected to the operation handle;

a cam member including one end inserted into the cylindrical portion and the other end connected to the other end of the slide pin; and a cam mechanism provided between the cylindrical portion and the cam member to transform a swinging motion of the operation handle into an axial movement of the slide pin, wherein the other end of the slide pin includes:

a post portion projecting in an axial direction of the slide pin; and double lateral projecting portions projecting to both sides from the post portion so as to form an edge on the other end of the slide pin, wherein the other end of the cam member includes:

an axial recess portion configured to open so as to receive the post portion along an insertion direction which is perpendicular to the axial direction; and lateral recess portions formed by extending a width of the axial recess portion at a lengthwise intermediate position thereof to receive the double lateral projecting portions to thereby restrict a movement of the slide pin in the axial direction, and wherein an end face of the other end of the slide pin which is situated around a proximal portion of the post portion and an end face of other end of the cam member face each other, so that portions of the both end faces which are positioned rearwards, in the insertion direction, of the double lateral projecting portions abut with each other upon a swinging movement of the slide pin with respect to the cam member around the lateral recess portions to thereby restrict the swinging movement of the slide pin.

4. The lock system according to claim 1, wherein a pair of projecting portions adapted to be brought into abutment with both lateral sides of the other end of the cam member are provided on an end face of the slide pin which is situated around the periphery of the proximal portion of the post portion.

5. The lock system according to claim 4, wherein the pair of projecting portions are provided in a position which is offset rearwards in the insertion direction, wherein guide recess portions are formed on the other end of the cam member from lateral side corner portions to an intermediate portion along the length thereof, and wherein the projecting portions are made to be inserted into the guide recess portions.

6. The lock system according to claim 1, wherein engagement projections situated at sides of the insertion direction are formed on respective end faces of the double side projecting portions of the slide pin, and wherein locking stepped portions with which the engagement projections are to be brought into engagement are provided on inner surfaces of the lateral recess portions of the cam member.

7. The lock system according to claim 6, wherein the projecting portions are disposed further rearwards in the insertion direction than the engagement projections formed on the double side projecting portions.

8. The lock system according to claim 1, wherein a distal end projection is formed on an axial end face of the post portion of the slide pin so as to be offset in the insertion direction, and wherein an elastic engagement piece including a locking claw portion with which the distal end projection is to be brought into engagement is provided inside the axial recess portion.

9. The lock system according to claim 8, wherein the elastic engagement piece bends to extend from an opening side towards a bottom portion side of the axial recess portion in the deep portion thereof, and wherein the locking claw portion is formed at a lower end portion thereof.

10. The lock system according to claim 8, wherein the distal end projection is disposed so as to be offset in the insertion direction from a center of the axial end face of the post portion of the slide pin.

11. The lock system according to claim 1, wherein the double side projecting portions of the slide pin each have an angular cross section, and wherein the lateral recess portions of the cam member has an inner circumferential surface to which at least one side of each of the double side projecting portions of the slide pin is fitted.

12. The lock system according to claim 6, wherein the engagement projections of the slide pin are formed on the respective end faces of the double side projecting portions rearwards in the insertion direction.

13. The lock system according to claim 1, wherein the post portion of the slide pin includes an angular cross section, and wherein the axial recess portion of the cam member has an inner circumferential surface to which at least one side of the post portion of the slide pin is fitted.

14. The lock system according to claim 2, wherein a pair of projecting portions adapted to be brought into abutment with both lateral sides of the other end of the cam member are provided on the end face of the slide pin which is situated around the periphery of the proximal portion of the post portion.

15. The lock system according to claim 3, wherein a pair of projecting portions adapted to be brought into abutment with both lateral sides of the other end of the cam member are provided on the end face of the slide pin which is situated around the periphery of the proximal portion of the post portion.

16. The lock system according to claim 2, wherein engagement projections situated at sides of the insertion direction are formed on respective end faces of the double side projecting portions of the slide pin; and wherein locking stepped portions with which the engagement projections are to be brought into engagement are provided on inner surfaces of the lateral recess portions of the cam member.

17. The lock system according to claim 3, wherein engagement projections situated at sides of the insertion direction are formed on respective end faces of the double side projecting portions of the slide pin, and wherein locking stepped portions with which the engagement projections are to be brought into engagement are provided on inner surfaces of the lateral recess portions of the cam member.

18. The lock system according to claim 2, wherein a distal end projection is formed on an axial end face of the post portion of the slide pin so as to be offset in the insertion direction, and wherein an elastic engagement piece having a locking, claw portion with which the distal end projection is to be brought into engagement is provided inside the axial recess portion.

19. The lock system according to claim 1, wherein a distal end of the double lateral projecting portions, in the axial direction of the slide pin, include an upper end portion comprising an angular corner portion and a lower portion formed in an arc shape when viewed from a projecting direction of the double lateral projecting portions.

20. The lock system according to claim 1, wherein the double lateral projecting portions are disposed on an axially distal end of the slide pin in relation to the post portion.

* * * * *